US006460975B2

(12) United States Patent
Suzuki

(10) Patent No.: US 6,460,975 B2
(45) Date of Patent: Oct. 8, 2002

(54) THERMAL HEAD AND INK TRANSFER PRINTER USING SAME

(75) Inventor: Minoru Suzuki, Tochigi (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/024,316

(22) Filed: Dec. 21, 2001

(65) Prior Publication Data

US 2002/0075373 A1 Jun. 20, 2002

Related U.S. Application Data

(62) Division of application No. 09/164,632, filed on Oct. 1, 1998.

(30) Foreign Application Priority Data

| | | |
|---|---|---|
| Oct. 2, 1997 | (JP) | P09-285983 |
| Oct. 9, 1997 | (JP) | P09-293485 |
| Oct. 9, 1997 | (JP) | P09-293486 |
| Oct. 15, 1997 | (JP) | P09-297818 |
| Oct. 15, 1997 | (JP) | P09-297819 |

(51) Int. Cl.[7] ..... B41J 2/05
(52) U.S. Cl. ..... 347/56
(58) Field of Search ..... 347/20, 54, 56, 347/61, 62

(56) References Cited

U.S. PATENT DOCUMENTS

| | | | | |
|---|---|---|---|---|
| 4,358,776 | A | | 11/1982 | Mitsui |
| 4,561,789 | A | | 12/1985 | Saito |
| 4,712,930 | A | | 12/1987 | Maruno et al. |
| 5,189,284 | A | | 2/1993 | Takahashi et al. |
| 5,206,659 | A | * | 4/1993 | Sakurai et al. ..... 347/62 |
| 5,956,066 | A | | 9/1999 | Suzuki |
| 6,145,976 | A | | 11/2000 | Suzuki et al. |
| 6,219,077 | B1 | | 4/2001 | Suzuki |
| 6,226,018 | B1 | | 5/2001 | Suzuki |
| 6,236,414 | B1 | | 5/2001 | Suzuki et al. |
| 6,239,816 | B1 | | 5/2001 | Suzuki |
| 6,256,050 | B1 | | 7/2001 | Iwayama et al. |

FOREIGN PATENT DOCUMENTS

| | | |
|---|---|---|
| EP | 0254420 | 1/1988 |
| EP | 0260992 | 3/1988 |
| EP | 0342243 | 11/1989 |
| EP | 0446918 | 9/1991 |
| EP | 0649748 | 4/1995 |
| GB | 2174038 | 10/1986 |
| GB | 2329870 | 4/1999 |

* cited by examiner

*Primary Examiner*—Huan Tran
(74) *Attorney, Agent, or Firm*—Greenblum & Bernstein, P.L.C.

(57) ABSTRACT

Ink transfer printer has an electrically-insulated base member, a plurality of electric resistance elements linearly formed on a surface of said base member, a frame member having an opening, securely provided on the surface of said base member such that said plurality of electric resistance elements are encompassed by said opening of said frame member, a sheet of film, having a linear perimeter side, adhered and sealed to said frame member, except for said linear perimeter side, such that said opening of said frame member is defined as an ink space that stores ink, said linear perimeter side of said film sheet extending along the linear formation of said plurality of electric resistance elements, and contacting a surface of said frame member. When each electric resistance element is electrically energized, a part of the ink penetrates said closed slit and then exits said closed slit as a fine ink drop.

9 Claims, 31 Drawing Sheets

THERMAL HEAD AND INK TRANSFER PRINTER USING SAME

This is a Divisional of U.S. patent application Ser. No. 09/164,632, filed Oct. 1, 1998, the contents of which are expressly incorporated by reference herein in their entireties.

BACKGROUND OF THE INVENTION

1. Field of the Invention

The present invention relates to a thermal line head and an ink transfer printer using the same, in which an ink drop or ink drops selectively appear in accordance with a digital image-pixel signal, thereby producing an ink dot on a recording sheet of paper.

2. Description of the Related Art

Conventionally, a thermal line head, incorporated into a thermal printer, comprises an elongated rectangular ceramic base plate, a plurality of electric resistance elements or electric heater elements linearly aligned on the base plate, and plural pairs of lead wire elements, arranged on the base plate, which are electrically contacted with and joined to the electric heater elements, respectively. One of the lead wire elements in each pair is electrically connected to a driver circuit of a thermal head controller, and the other lead wire element is electrically grounded. The heater elements are selectively and electrically energized by the driver circuit, in accordance with a series of digital image-pixel signals, in a well-known manner.

With this conventional arrangement of the thermal line head, the electrical energization of the electric heater elements cannot be efficiently performed, because contact resistance is exhibited at connections between each of the electric heater elements and the pair of lead wire elements associated therewith. Namely, the electrical energy, to be applied to an electric heater element, is inefficiently used due to the existence of the contact resistance between the electric heater element concerned and the pair of lead wire elements associated therewith.

SUMMARY OF THE INVENTION

Therefore, an object of the present invention is to provide a thermal line head including a plurality of electric resistance elements or electric heater elements selectively and electrically energized in accordance with a series of digital image-pixel signals, wherein the energization of the electric heater elements can We efficiently performed.

Another object of the present invention is to provide a novel ink transfer printer which can advantageously use the aforesaid thermal line head.

Yet another object of the present invention is provide various types of thermal line heads and various types of novel ink transfer printers advantageously using these types of thermal line head.

In accordance with a first aspect of the present invention, there is provided a thermal line head comprising: an electrically-insulated base member; and a monolithic electrically-conductive pattern formed on a surface of the base member. The monolithic electrically-conductive pattern includes a plurality of first electrode sections, a plurality of second electrode sections and a plurality of constrictions, each of the plurality of constrictions extending between one of the plurality of first electrode sections and a corresponding one of the plurality of second electrode sections. The a cross-sectional area of the plurality of constrictions is smaller than that of the plurality of first and second electrode sections, whereby each of the plurality of constrictions serves as an electric resistance element.

The monolithic electrically-conductive pattern may be formed as a metal layer. Optionally, the monolithic electrically-conductive pattern may be formed as an electrically-conductive layer composed of an electrically-conductive coating material. Also, the monolithic electrically-conductive pattern further may include a grounded common terminal section electrically connected to the second plurality of electrode sections.

In the first aspect of the present invention, the thermal line head may further comprise an integrated driver circuit pattern formed on the surface of the base member, the integrated driver circuit pattern being electrically connected to the plurality of first electrode sections of the monolithic electrically-conductive pattern, such that the electric resistance elements are selectively and electrically energized in accordance with a series of digital image-pixel signals. If necessary, the electric resistance elements is at least covered with a protective layer, which a thermal resistance layer interposed between the electric resistance elements and the surface of the base member.

In accordance with the first aspect of the present invention, there is also provided an ink transfer printer, having the aforesaid thermal line head according to this first aspect, comprising: a frame member, having an opening, securely provided on the thermal line head such that the electric resistance elements are encompassed by the opening of the frame member; and a sheet of film that covers the frame member such that the opening of the frame member is defined as an ink space that stores ink, the film sheet including a plurality of fine pores arranged along an alignment of the electric resistance elements, at least one of the plurality of fine pores being allocated to and associated with each of the electric resistance elements. When each of the electric resistance elements is electrically energized to thereby generate thermal energy, an ink drop is formed on the film sheet from a corresponding pore thereof, due to the generation of the thermal energy.

Preferably, the film sheet is positioned with respect to the frame member such that each of the plurality of the pores is placed just above the corresponding one of the plurality of electric resistance elements.

In the first aspect of the present invention, the ink transfer printer may further comprise an ink reservoir provided on the thermal line head, the ink reservoir communicating with the ink space via a passage formed in the frame member, whereby the ink space is fed with ink from the ink reservoir.

In accordance with a second aspect of the present invention, there is provided a thermal line head comprising: an electrically-insulated base member; plural sets of at least two electric resistance elements formed on a surface of the base member and aligned with each other; and a driver circuit that selectively and electrically energizes the at least two electric resistance elements in each set in accordance with an associated digital image-pixel signal and an associated digital gradation-signal. When the digital image-pixel signal has a value "0", none of the at least two electric resistance elements in a corresponding set are electrically energized. When the digital image-pixel signal has a value "1", the selective and electrical energization of the at least two electric resistance elements in the corresponding set are performed in accordance with values of the digital gradation-signal, whereby a total thermal energy output of each of the plural sets of at least two electric resistance elements is stepwisely adjustable.

In the second aspect of the present invention, the driver circuit may be provided on the surface of the base member. Also, the at least two electric resistance elements in each set may have identical resistance values or different resistance values.

Preferably, one set of the plural sets of at least two electric resistance elements contains four electric resistance elements, two of the four electric resistance elements having first identical resistance values, a remaining two of the four electric resistance elements having second identical resistance values different from the first identical resistance values.

In accordance with the second aspect of the present invention, there is also provided an ink transfer printer, having the aforesaid thermal line head according to this second aspect, comprising: a frame member, having an opening, securely provided on the thermal line head such that the plural sets of at least two electric resistance elements are encompassed by the opening of the frame member; and a sheet of film that covers the frame member such that the opening of the frame member is defined as an ink space filled with ink, the film sheet including a plurality of fine pores arranged along an alignment of the plural sets of at least two electric resistance elements, at least one of the plurality of fine pores being allocated to and associated with each of the plural sets of at least two electric resistance elements. When the electric resistance elements in each set are selectively and electrically energized to generate thermal energy, an ink drop is formed on the film sheet from one of the plurality of fine pores corresponding to the generation of the thermal energy, with a size of the ink drop being stepwisely varied in accordance with a value of the digital gradation-signal.

In the second aspect of the present invention, the ink transfer printer may further comprise an ink reservoir provided on the thermal line head, the ink reservoir communicating with the ink space via a passage formed in the frame member, whereby the ink space is fed with ink from the ink reservoir.

In accordance with a third aspect of the present invention, there is provided a thermal line head comprising: an electrically-insulated base member; a plurality of electric resistance elements linearly formed on a surface of the base member; and an electrically-conductive wiring pattern arrangement formed on the surface of the base member, the electrically-conductive wiring pattern arrangement electrically activating the plurality of electric resistance elements. The electrically-conductive wiring pattern arrangement is constituted such that each of the electric resistance elements is surrounded by at least two pattern elements included in the electrically-conductive wiring pattern arrangement.

The electrically-conductive wiring pattern arrangement may include plural sets of first and second electrode patterns elements disposed so as to partially surround and electrically contact a corresponding one of the plurality of electric resistance elements. In this case, preferably, each of the first electrode pattern elements is formed as an L-shaped electrode pattern element, and each of the second electrode pattern elements is formed as a rectangular pattern element, the L-shaped electrode pattern element and the rectangular pattern element in each set act in conjunction with each other to surround the corresponding one of the plurality of electric resistance elements.

The electrically-conductive wiring pattern arrangement may further include a grounded common terminal pattern element electrically connected to the second electrode elements. In this case, preferably, the grounded common terminal pattern element contributes to surround the corresponding one of the plurality of electric resistance elements.

Optionally, the electrically-conductive wiring pattern arrangement includes a plurality of electrode pattern elements electrically connected to the plurality of electric resistance elements, and a grounded common terminal pattern element electrically connected to the plurality of electric resistance elements, such that two consecutive electrode pattern elements in conjunction with the grounded common terminal pattern element surround a corresponding one of the plurality of electric resistance elements. In this case, preferably, each of the electrode pattern elements is formed as an L-shaped electrode pattern element, and two consecutive L-shaped electrode pattern elements act in conjunction with each other to surround the corresponding one of the plurality of electric resistance elements.

In accordance with the third aspect of the present invention, there is also provided an ink transfer printer, having the aforesaid thermal line head according to this third aspect, comprising: a frame member, having an opening, securely provided on the thermal line head such that the plurality of electric resistance elements are encompassed by the opening of the frame member; and a sheet of film that covers the frame member such that the opening of the frame member is defined as an ink space that stores ink, the film sheet including a plurality of fine pores arranged along an alignment of the plurality of electric resistance elements, at least one of the plurality of fine pores being allocated to and associated with each of the plurality of electric resistance elements. When each of the electric resistance elements is electrically energized to generate thermal energy, an ink drop is formed on the film sheet from one of the plurality of fine pore corresponding to the generation of the thermal energy, with the thermal energy being efficiently localized in the vicinity of the heated resistance element, due to the surrounding of each of the electric resistance elements by the pattern elements included in the electrically-conductive wiring pattern arrangement.

In the third aspect of the present invention, the ink transfer printer may further comprise an ink reservoir provided on the thermal line head, the ink reservoir communicating with the ink space via a passage formed in the frame member, whereby the ink space is fed with ink from the ink reservoir.

In accordance with a fourth aspect of the present invention, there is provided an ink transfer printer comprising: an electrically-insulated base member; an electrically-conductive wiring pattern arrangement provided on a surface of the base member, the electrically-conductive wiring pattern arrangement including linearly-aligned plural sets of first and second electrode pattern elements, plural sets of first and second electric resistance elements that are linearly aligned on the electrically-conductive wiring pattern arrangement such that the first and second electric resistance elements in each set are electrically connected to a corresponding one set of the first and second electrode pattern elements; and a sheet of film provided on the surface of the base member so as to cover the electrically-conductive wiring pattern arrangement and the plural sets of first and second electric resistance elements to thereby define an ink space, that stores ink, between the sheet film and the surface of the base plate, the film sheet having a plurality of fine pores arranged along the alignment of the plural sets of first and second electric resistance elements, at least one of the plurality of fine pores being positioned between the first and second electric resistance elements in each set. The plural sets of first and second electric resistance elements are securely pre-attached to an inner surface of the film sheet. When the first and second electric resistance elements in each set are electrically energized to thereby generate thermal energy, an ink drop is formed on the film sheet from one of the plurality of fine pores corresponding the generation of the thermal energy.

In this ink transfer printer, the plural sets of first and second electrode pattern elements, together with the plural sets of first and second electric resistance elements, may be securely pre-attached to the inner surface of the film sheet.

Optionally, the electrically-conductive wiring pattern arrangement may further include a grounded common terminal pattern element provided on the surface of the base member so as to be electrically connected to the first and second electric resistance elements in each set. In this case, preferably, the grounded common terminal pattern element, together with the plural sets of first and second electric resistance elements, is securely pre-attached to the inner surface of the film sheet.

Optionally, the electrically-conductive wiring pattern arrangement may further include a driver circuit device provided on the surface of the base member such that the electrical energization of one of the plural sets of first and second electric resistance elements is selectively performed through the corresponding one set of the first and second electrode pattern elements in accordance with a digital image-pixel signal. In this case, preferably, the driver circuit device, together with the plural sets of first and second electric resistance elements, is securely pre-attached to the inner surface of the film sheet.

In the fourth aspect of the present invention, the ink transfer printer may further comprise an ink reservoir provided on the surface of the base member, the ink reservoir having a spout portion, to which a side of the film sheet is adhered and sealed, whereby the ink reservoir is in communication with the ink space such that the ink space is fed with ink from the ink reservoir.

In accordance with the fourth aspect of the present invention, there is further provided another type of ink transfer printer comprising: an electrically-insulated base member; an electrically-conductive wiring pattern arrangement provided on a surface of the base member, the electrical conductive wiring pattern arrangement including a plurality of linearly aligned electrode pattern elements, a plurality of electric resistance elements provided and aligned on the electrical conductive wiring pattern arrangement such that the respective electric resistance elements are electrically connected to the electrode pattern elements; and a sheet of film provided on the surface of the base member so as to cover the electrical conductive wiring pattern arrangement and the electric resistance elements to thereby define an ink space, that stores ink, between the sheet film and the surface of the base plate, the film sheet being formed with a fine groove extending along the alignment of the plurality of electric resistance elements, and having a plurality of fine pores which are formed in and arranged along the alignment of the plurality of electric resistance elements, at least one of the plurality of fine pores being allocated to and associated with each of the plurality of electric resistance elements. The electric resistance elements are securely pre-attached to an inner surface of the film sheet. When each of the plurality of electric resistance elements is electrically energized to generate thermal energy, an ink drop is formed on the film sheet from one of the plurality of fine pores corresponding to the generation of the thermal energy.

In this other type of ink transfer printer according to the fourth aspect of the present invention, the plurality of electrode pattern elements, together with the plurality of electric resistance elements, may be securely pre-attached to the inner surface of the film sheet.

Optionally, the electrically-conductive wiring pattern arrangement may further include a grounded common terminal pattern element provided on the surface of the base member so as to be electrically connected to the plurality of electric resistance elements. In this case, preferably, the grounded common terminal pattern element, together with the plurality of electric resistance elements, is securely pre-attached to the inner surface of the film sheet.

Optionally, the electrically-conductive wiring pattern arrangement may further include a driver circuit device provided on the surface of the base member such that the electrical energization of each of the plurality of electric resistance elements is selectively performed through a corresponding one of the plurality of electrode pattern elements, in accordance with a digital image-pixel signal. In this case, preferably, the driver circuit device, together with the plurality of electric resistance elements, is securely pre-attached to the inner surface of the film sheet.

In this other type of ink transfer printer according to the forth aspect of the present invention, the ink transfer may further comprise an ink reservoir provided on the surface of the base member, the ink reservoir having a spout portion, to which a side of the film sheet is adhered and sealed, whereby the ink reservoir communicates with the ink space such that the ink space is fed with ink from the ink reservoir.

In accordance with a fifth aspect of the present invention, there is provided an ink transfer printer comprising: an electrically-insulated base member; a plurality of electric resistance elements linearly formed on a surface of the base member; a frame member, having an opening, securely provided on the surface of the base member such that the plurality of electric resistance elements are encompassed by the opening of the frame member; a sheet of film, having a linear perimeter side, adhered and sealed to the frame member, except for the linear perimeter side, such that the opening of the frame member is defined as an ink space that stores ink, the linear perimeter side of the film sheet extending along the linear formation of the plurality of electric resistance elements, and contacting a surface of the frame member; and a platen roller rotatably provided above and in contact with the film sheet such that a rotational axis of the platen roller is in parallel with the linear formation of the plurality of electric resistance elements, the linear perimeter side of the film sheet being pressed against the surface of the frame member so as to form a closed slit therebetween. When each of the electric resistance elements is electrically energized to generate thermal energy, a part of the ink penetrates the closed slit, due to the generation of the thermal energy, and then exits the closed slit as a fine ink drop.

In the fifth aspect of the present invention, the ink transfer printer may further comprise an ink reservoir provided on the surface of the base member, the ink reservoir communicating with the ink space via a passage formed in the frame member, whereby the ink space is fed with ink from the ink reservoir.

In accordance with the fifth aspect of the present invention, there is further provided another type of ink transfer printer an ink transfer printer comprising: an electrically-insulated base member;

a plurality of electric resistance elements linearly formed on a surface of the base member; a spacer member securely provided on the surface of the base member along the linear formation of the plurality of electric resistance elements; a sheet of film, having a linear perimeter side, adhered and sealed to the spacer member and the surface of the base member, except for the linear perimeter side, such that an ink space, that stores ink, is defined so as to include the linear formation of the plurality of electric resistance elements, the linear perimeter side of the film sheet extending along the linear formation of the plurality of electric resistance elements, and contacting the surface of the base member; and a platen roller that is rotatably provided above and in contact with the film sheet such that a rotational axis of the platen roller is in parallel with the linear formation of the plurality of electric resistance elements, the linear perimeter side of the film sheet being pressed against the surface of the base member so as to form a closed slit therebetween. When each of the plurality electric resistance elements is electrically energized to thereby generate thermal energy, a part of the ink penetrates the closed slit, due to the generation of the thermal energy, and then exits the closed slit as a fine ink drop.

In this other type of ink transfer printer according to the fifth aspect of the present invention, the ink transfer printer may further comprise an ink reservoir provided on the surface of the base member, the ink reservoir communicating with the ink space via a passage formed in the spacer member, whereby the ink space is fed with ink from the ink reservoir.

In each of the aforesaid aspects of the present invention, preferably, the film sheet is formed of a suitable synthetic resin material, such as polytetrafluoroethylene, exhibiting at least a moderate elasticity, a wear-resistant property and a thermal-resistant property.

BRIEF DESCRIPTION OF THE DRAWINGS

These objects and other objects of this invention will be better understood from the following description, with reference to the accompanying drawings in which.

DESCRIPTION OF THE PREFERRED EMBODIMENTS

Figure 1:
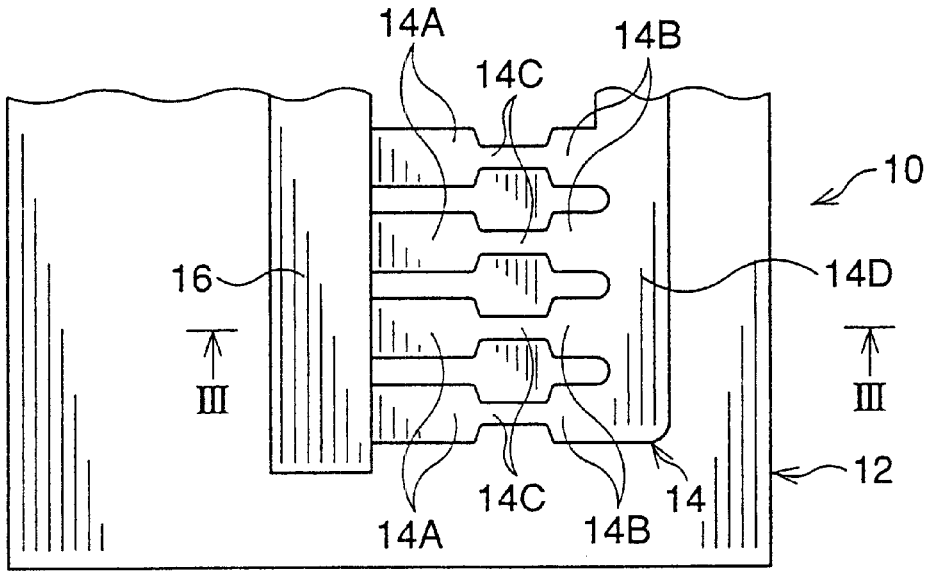
FIG. 1 is a schematic partial plan view showing a first embodiment of a thermal line head, according to a first aspect of the present invention.

FIG. 1 shows a thermal line head, generally indicated by a reference numeral 10, according to a first aspect of the present invention, which will be referred to as a first embodiment of the thermal line head, hereinafter.

In this first embodiment, the thermal line head 10 comprises an elongated rectangular base plate 12 formed of, for example, a suitable ceramic material, and a monolithic electrical conductive pattern 14 formed on a surface of the base plate 12. The monolithic electrical conductive pattern 14 may be obtained as a suitable metal layer, such as a copper alloy layer, produced by using photolithography, or may be formed as an electrical conductive layer composed of a suitable electrical conductive coating material.

As shown in FIG. 1, the electrical conductive pattern 14 includes a plurality of first electrode sections 14A; a plurality of second electrode sections 14B corresponding to the first electrode sections 14A, respectively; a plurality of constrictions 14C extending between the respective first and second electrode sections 14A and 14B; and a grounded common terminal section 14D integrated with the second electrode sections 14B. Each of the constrictions 14C exhibits a large electrical resistance, because a cross-sectional area of the constrictions 14C is considerably smaller than that of the first and second electrode sections 14A and 14B. Thus, each of the constrictions 14C serves as an electric resistance element or electric heater element.

The thermal line head 10 also comprises an integrated driver circuit pattern 16, formed on the surface of the base plate 12, which may be obtained by using photolithography. The driver circuit pattern 16 is electrically connected to the first electrode sections 14A of the electrical conductive pattern 14, such that the electric heater elements 14C are selectively and electrically energized, in accordance with a series of digital image-pixel signals, in a well-known manner.

Figure 2:
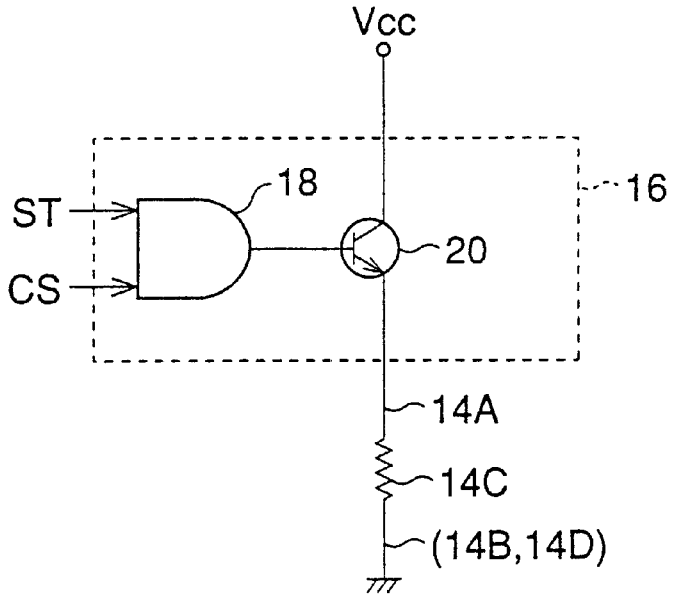
FIG. 2 is a schematic partial block diagram of an integrated driver circuit pattern formed on a surface of the thermal line head shown in FIG. 2.

In particular, the driver circuit pattern 16 includes plural sets of AND-gate circuits and transistors respectively associated with the heater elements 14C. With reference to FIG. 2, an AND-gate circuit and a transistor in one set are representatively shown and indicated by references 18 and 20, respectively. A strobe signal "ST" and a control signal "CS" are inputted to two input terminals of the AND-gate circuit 18, as shown in FIG. 2. A base of the transistor 20 is connected to an output terminal of the AND-gate circuit 18; a collector of the transistor 20 is connected to an electric power source ($V_{cc}$); and an emitter of the transistor 20 is connected to a corresponding electrode section 14A.

Although the strobe signal "ST" has a predetermined pulse width, the control signal "CS" varies in accordance with binary values of a digital image-pixel signal. Namely, when the digital image-pixel signal has a value "1", the control signal "CS" exhibits a high-level pulse having the same pulse width as that of the strobe signal "ST", whereas, when the digital image-pixel signal has a value "0", the control signal "CS" is maintained at a low-level.

Accordingly, when the digital image-pixel signal has the value "1", i.e. when the control signal "CS" exhibits the high-level pulse, an output of the AND-gate circuit 18 is changed from the low-level to the high-level, thereby turning ON the transistor 20. Thus, a corresponding electric heater element 14C is electrically energized during a period corresponding to the pulse width of the strobe signal "ST", whereby the electric heater element 14C concerned produces thermal energy, resulting in the heating of the heater element 14C concerned to a predetermined temperature.

On the other hand, when the digital image-pixel signal has the value "0", i.e when the control signal "CS" is kept at the low-level, an output of the AND-gate circuit 18 is also at a low-level, thereby maintaining the OFF condition of the transistor 20. Thus, a corresponding electric heater element 14C is not electrically energized, whereby the electric heater element 14C concerned cannot be heated.

Figure 3:
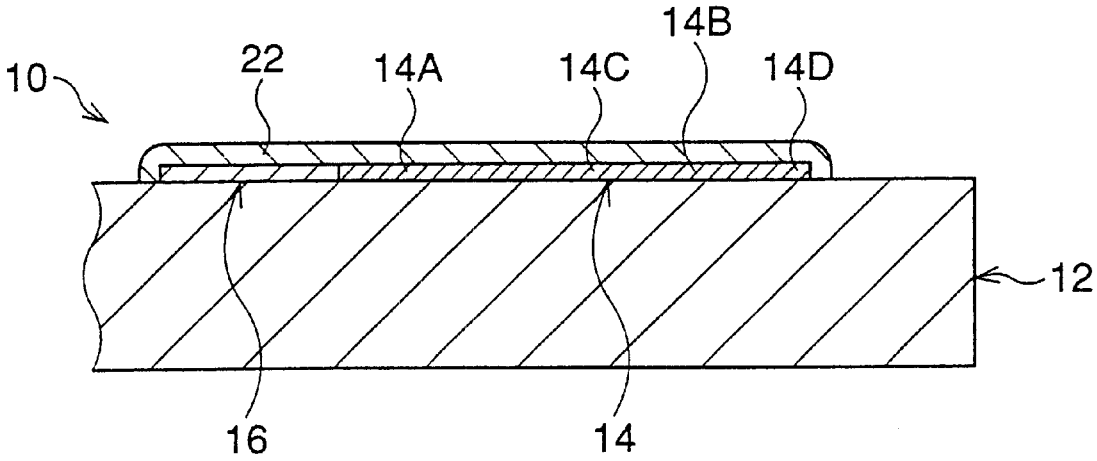
FIG. 3 is a schematic cross-sectional view taken along a line III—III of FIG. 1.

Although not shown in FIG. 1 due to the illustration of the electric conductive pattern 14 and the driver circuit pattern 16, as shown in FIG. 3, these patterns 14 and 16 are covered with a protective layer 22, exhibiting a high thermal conductivity. For example, the protective layer 22 may be formed as a very thin silicone resin layer. Note, the protective layer 22 may be omitted, if necessary.

Figure 4:
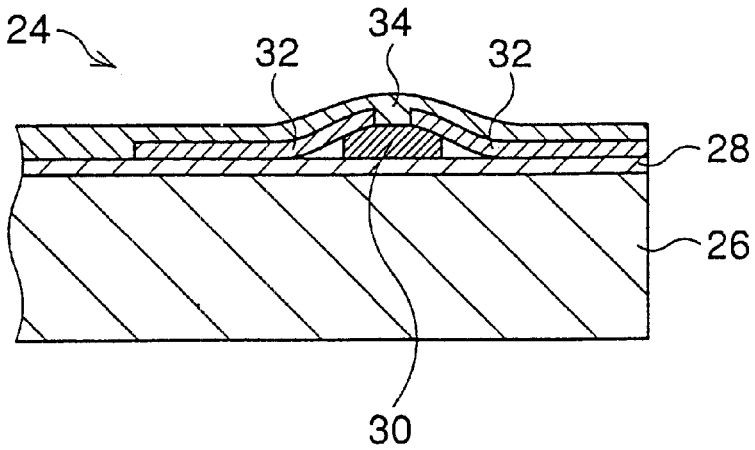
FIG.4 (PRIOR ART)
FIG. 4 is a schematic cross-sectional view, corresponding to FIG. 3, showing a conventional thermal line head.

FIG. 4 representatively shows an arrangement of a conventional thermal line head, generally indicated by reference 24. The thermal line head 24 comprises an elongated rectangular ceramic base plate 26, and a thermal resistance glass layer 28 formed over a surface of the base plate 26. A plurality of electric heater elements 30, exhibiting a high electric resistance, is securely placed on a surface of the glass layer 28, and a pair of lead wire elements 32 electrically contact and join each of the electric heater elements 30. The electric heater elements 30 and the lead wire elements 32 are covered with a protective layer 34, exhibiting a high thermal conductivity. One of the lead wire elements 32 is electrically connected to a driver circuit of a thermal head controller (not shown), and the other lead wire element 32 is grounded. The electric heater elements 30 are selectively and electrically energized by the driver circuit in substantially the same manner as mentioned above.

With this conventional arrangement of the thermal line head, the electrical energization of the electric heater elements 30 cannot be effectively performed, because contact resistance is exhibited at connections between each of the electric heater elements 30 and the pair of lead wire elements 32 associated therewith. Namely, the electrical energy, to be applied to an electric heater element 30, is inefficiently used due to the existence of the contact resistance between the electric heater element concerned and the pair of lead wire elements associated therewith.

On the contrary, according to the first embodiment of the thermal line head 10, it is possible to effectively and efficiently perform the electrical energization of an electric heater element 14C, because no contact resistance is exhibited at locations between the electric heater element 14C concerned and the first and second electrode sections 14A and 14B, due to the monolithic property of the electric conductive pattern 14.

Figure 5:
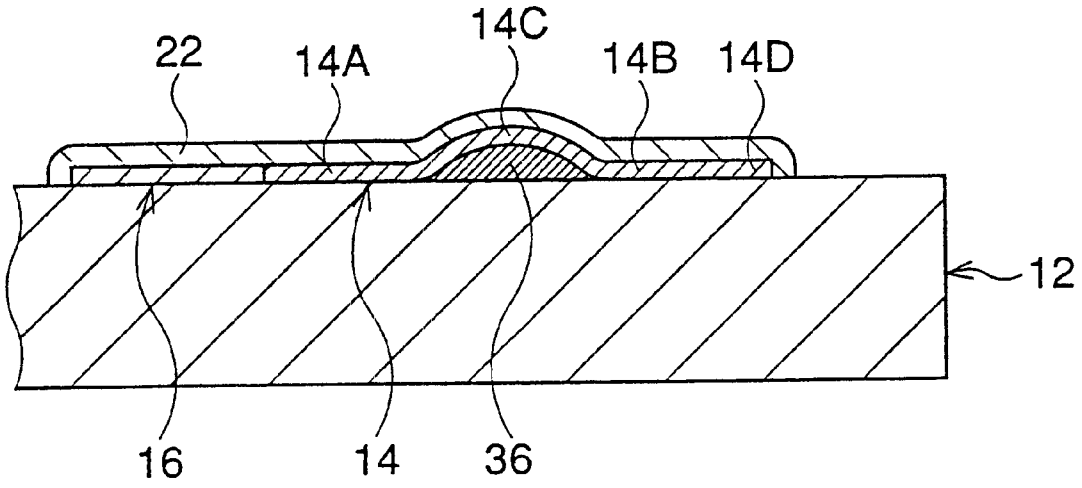
FIG. 5 is a schematic cross-sectional view, corresponding to FIG. 3, showing a modification of the first embodiment of the thermal line head of FIG. 1.

FIG. 5 shows a modification of the first embodiment of the thermal line head 10, shown in FIGS. 1 to 3. Note, in FIG. 5, the features similar to those of FIG. 3 are indicated by the same reference numerals. In this modified embodiment, an elongated thermal resistance glass layer 36 is locally formed on the base plate 12, and the monolithic electric conductive pattern 14 is formed over the surface of the base plate 12, such that the constrictions or electric heater elements 14C traverse the thermal resistance glass layer 36. With this arrangement, thermal energy, produced by each of the heater elements 14C, can be prevented from dissipating through the base plate 12.

Optionally, in place of the thermal resistance glass layer 26, a plurality of thermal resistance glass deposits may be formed on the base plate 12, such that each of the heater elements 14C is placed on the corresponding thermal resistance glass deposit.

Figure 6:
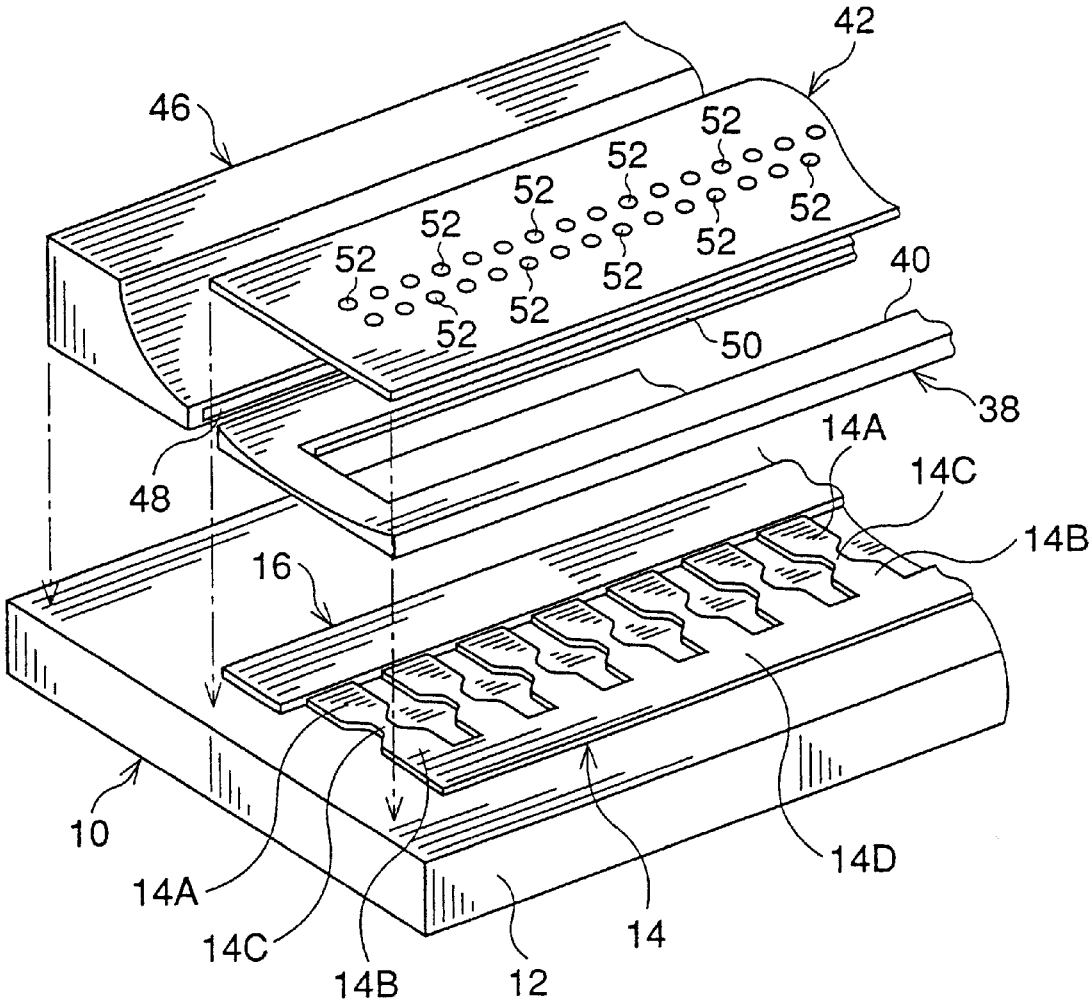
FIG. 6 is a schematic perspective exploded view of a first embodiment of an ink transfer printer according to the first aspect of the present invention.
Figure 7:
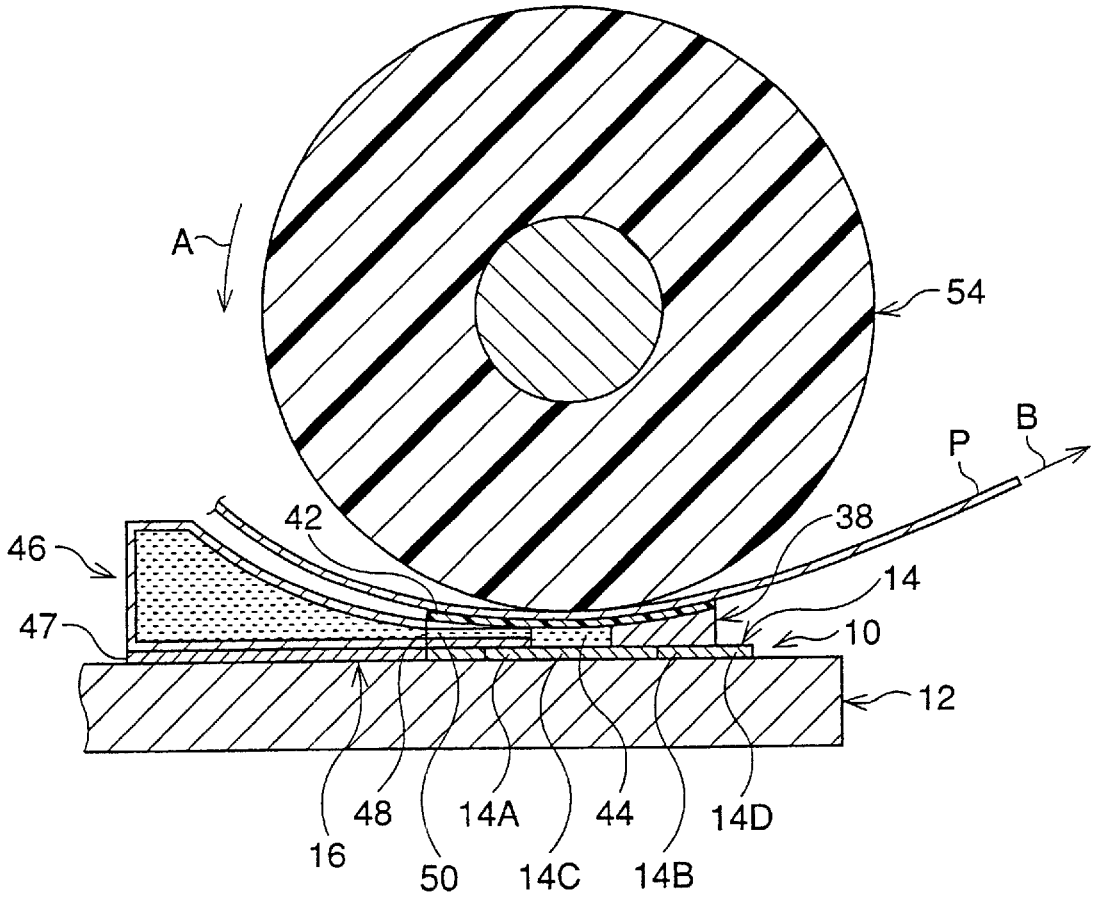
FIG. 7 is a schematic cross-sectional view of the first embodiment of the ink transfer printer shown in FIG. 6.

FIGS. 6 and 7 show an ink transfer printer, according to the first aspect of the present invention, which will be referred to as a first embodiment of the ink transfer printer, and in which the above-mentioned thermal line head 10 is incorporated as one element of the ink transfer printer. Note, the driver circuit pattern 16 is electrically connected to a printer controller (not shown) of the ink transfer printer, and the strobe signal "ST" and the control signals "CS" are inputted from the printer controller to the driver circuit pattern 16.

The ink transfer printer comprises an elongated rectangular frame member 38 securely provided on the thermal line head 10, and the frame member 38 is formed with an elongated rectangular opening 40 extending in a length direction thereof. Namely, as shown in FIG. 7, the frame member 38 is placed on the patterns 14 and 16 such that the plurality of electric heater elements 14C of the pattern 14 is encompassed by the rectangular opening 40. The frame member 38 may be formed of a suitable electrical insulation material, exhibiting a non-permeability to a liquid ink.

The ink transfer printer also comprises a sheet of film 42 securely adhered to the frame member 38 such that the rectangular opening 40 is covered with the film sheet 42, thereby defining an ink space 44 (FIG. 7). Note, there may be a gap of about 0.1 mm between the film sheet 42 and the surface of the thermal head 10, and the film sheet 42 may have a thickness of about 0.03 to about 0.08 mm. Preferably, the film sheet 42 is formed of a suitable synthetic resin material, exhibiting a moderate elasticity, a wear-resistant property and a thermal-resistant property. For example, polytetrafluoroethylene can be advantageously used for the film sheet 42.

The ink transfer printer further comprises an ink reservoir 46 securely mounted on the base plate 12 by using, for example, a suitable adhesive 47. The ink reservoir 46 has an elongated spout 48 formed therein (FIG. 6), which is securely joined to a wide capillary passage 50, formed in and extending along one of the longitudinal sides of the frame member 38, such that the ink reservoir 46 is in communication with the ink space 44 via the wide capillary passage 50. Thus, liquid ink, held in the ink reservoir 46, can be drawn into the ink space 44, due to capillary action of the wide capillary passage 50. Namely, the ink space 44 is fed and filled with the liquid ink from the ink reservoir 46.

As shown in FIG. 6, the film sheet 42 is provided with a plurality of pores 52 formed therein. In this embodiment, the pores 52 are aligned with each other in two rows, and the two rows of pores 52 extend above the alignment of the electric heater elements 14C. Note, although the pores 52 are exaggeratively illustrated in FIG. 6, in reality, the pores 52 are microscopic.

The film sheet 42 is produced, for example, as follows:

Initially, a blank sheet of film is omnidirectionally pulled so as to be elastically expanded, and is then pierced by fine needles or fine lasers, such that a plurality of pores (52) is formed in the blank film sheet. Thereafter, the pierced blank film sheet is released from the pulling forces, and is then trimmed or shaped as the film sheet 42 with the pores 52.

Note, when the pierced blank film sheet is released from the pulling forces, the pores 52 usually elastically close, so that the liquid ink, held in the ink space 44, cannot permeate and penetrate through the pores 52.

As shown in FIG. 7, furthermore, the ink transfer printer comprises a platen roller 54 constituted as a rubber roller, and the platen roller 54 is rotatably provided above and in contact with the film sheet 42 such that a rotational axis of the platen roller 54 is in parallel with the alignment of the electric heater elements 14C. The platen roller 54 is rotated, in a direction indicated by an arrow A in FIG. 7, with a suitable electrical motor (not shown). During the rotation of the platen roller 54, a sheet of recording paper P, introduced into a nip between the film sheet 42 and the platen roller 54, is subjected to a traction force from the rotating platen roller 54, and thus the recording paper sheet P is moved in a direction indicated by an arrow B in FIG. 7.

Figure 8:
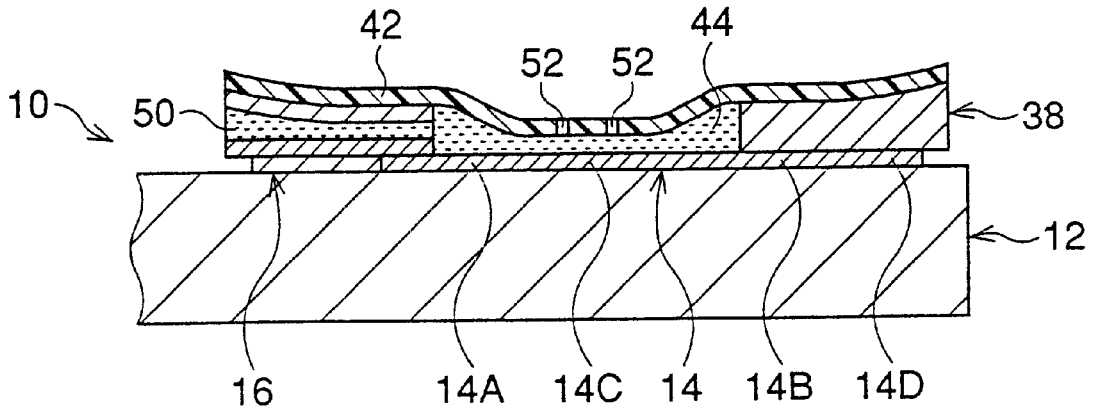
FIG. 8 is a schematic partially-enlarged cross-sectional view of the ink transfer printer, shown in FIG. 7, for explaining a principle of a printing operation according to the first aspect of the present invention.
Figure 9:
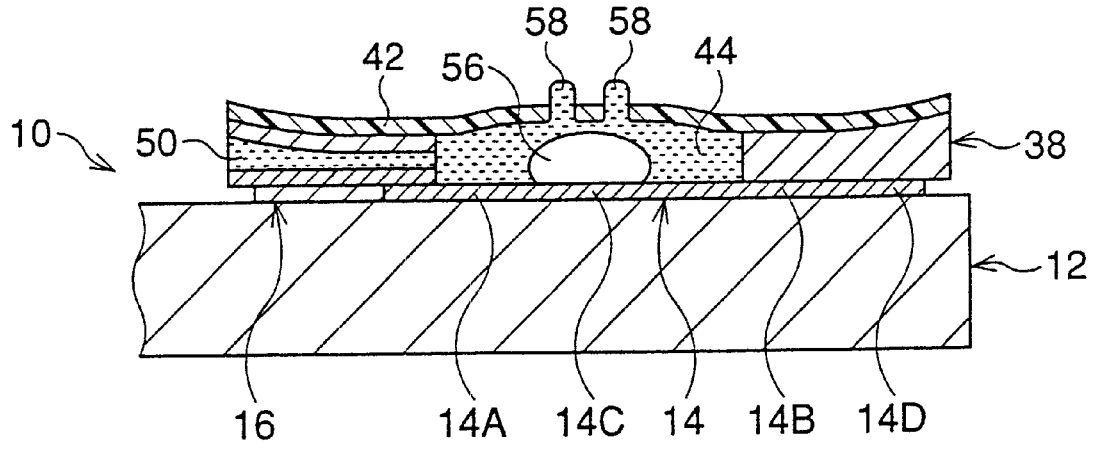
FIG. 9 is a schematic partially-enlarged cross-sectional view, similar to FIG. 8, showing the ink transfer printer concerned during the printing operation.

With reference to FIGS. 8 and 9, a principle of a printing operation, as performed by the ink transfer printer according to the first aspect of the present invention, is conceptually illustrated.

An elongated central area of the film sheet 42, in which the pores 52 are formed, is usually located in extremely close proximity to the electric heater elements 14C, as shown in FIG. 8, or is in actual contact with the heater elements 14C. When one of the electric heater elements 14C is heated by an electrical energization thereof, the electric heater element concerned is heated to a predetermined temperature.

Thus, a part of the ink, in contact with the heated heater element 14C, is vaporized, thereby producing a bubble 56, as shown in FIG. 9. Also, a local area of the film sheet 42, corresponding to the heated heater element 14C, is heated so that a modulus of elasticity of the heated local area is decreased. As a result, the heated local area of the film sheet 42 inflates due to the decrease in the modulus of elasticity thereof and due to the vapor pressure generated in the bubble 56. Further, a part of the ink, pressurized by the vapor pressure, can permeate and penetrate into the pores 52, which are included in the inflated local area of the film sheet 42, and thus these pores 52 are widened.

Accordingly, the permeated and penetrated ink appears as fine ink drops 58 on the inflated local area, corresponding to the heated heater element 14C, of the film sheet 42, as shown in FIG. 9. If the recording paper sheet P is interposed between the film sheet 42 and the platen roller 54, as shown in FIG. 7, the fine ink drops 58 are transferred to the paper sheet P, and the transferred fine ink drops 58 produce a single dot on the paper sheet P. The transfer of the ink drops 58 to the paper sheet P should be completely performed, because, if a part of each ink drop is left on the film sheet 42, the paper sheet P is stained with the remaining ink. The film sheet 42, formed of polytetrafluoroethylene, exhibits a high transferability of a liquid ink to a sheet of recording paper.

Of course, a size (diameter) of the single dot depends on a number of the pores 52 included in the local area of the film sheet 42, a pierced size of each pore 52, a temperature reached by the heated heater element 14C and so on. Note, the size of the single dot may be about 50 $\mu$m to about 100 $\mu$m.

When the electrical energization of the heater element 14C concerned is stopped, the bubble 56 condenses and the heated and inflated local area of the film sheet 42 is cooled by the surrounding ink held in the ink space 44, leading to a return to the original condition, as shown in FIG. 8.

In short, by selectively heating the electric heater elements 14C in accordance with a series of digital image-pixel signals, it is possible to record and print images on the paper sheet P on the basis of the digital image-pixel signals.

Before a printing speed of the ink transfer printer can be increased, it is necessary to improve a thermal response of the thermal line head 10. According to the first aspect of the present invention, the improvement of the thermal response of the thermal line head 10 can be ensured, because the electrical energization of the electric heater elements 14C can be efficiently performed, due to the monolithic property of the electrical conductive pattern 14, as mentioned above.

In the first embodiment of the ink transfer printer according to the first aspect of the present invention, although the film sheet 42 has the pores 52 regularly aligned with each other in two rows, a multitude of further microscopic pores can be randomly and homogeneously distributed over an elongated central area of the film sheet 42, in place of the aligned pores 52.

Figure 10:
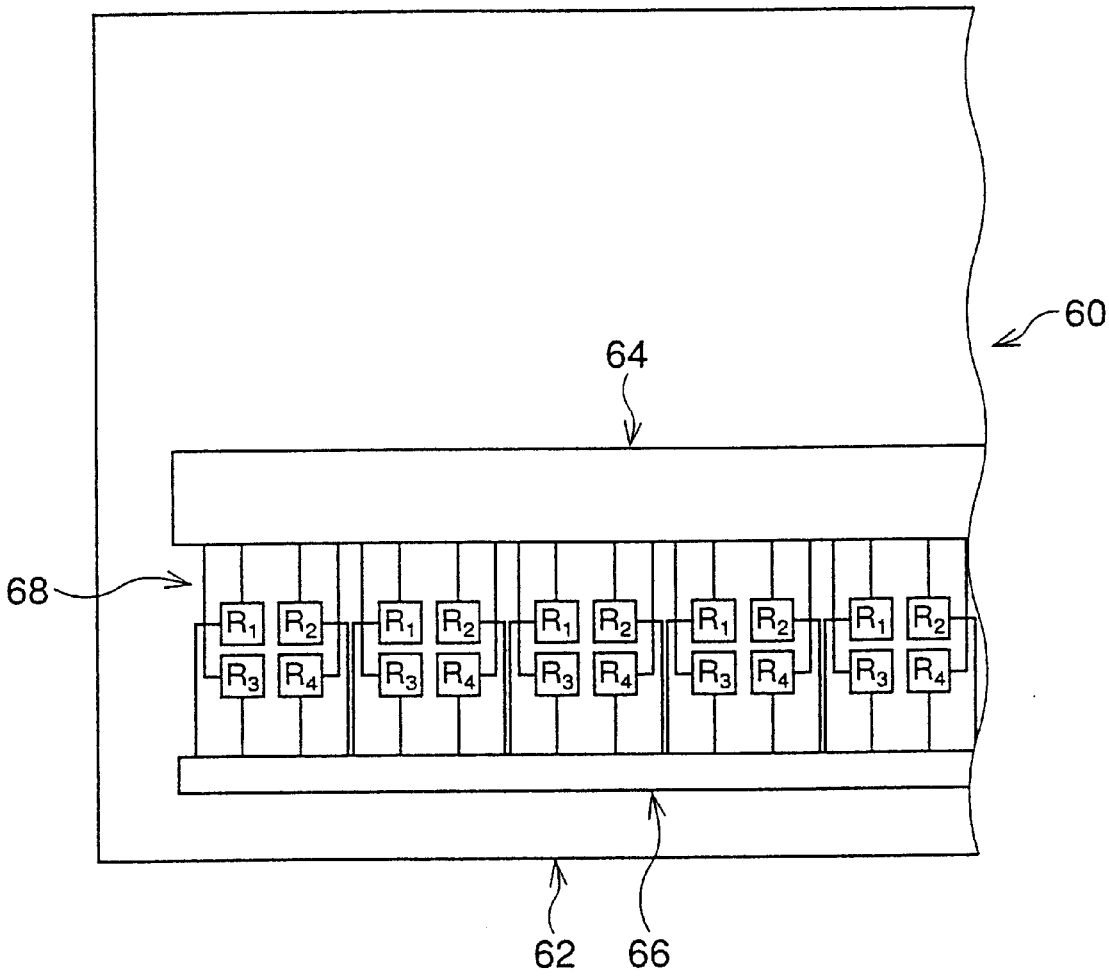
FIG. 10 is a schematic partial plan view showing a second embodiment of a thermal line head, according to a second aspect of the present invention.

FIG. 10 shows a thermal line head, generally indicated by reference numeral 60, according to a second aspect of the present invention, which will be referred to as a second embodiment of the thermal line head.

In the second aspect of the present invention, the thermal line head 60 comprises an elongated rectangular base plate 62 formed of a suitable ceramic material, and plural sets of four electric resistance elements or electric heater elements $R_1$, $R_2$, $R_3$ and $R_4$ aligned on a surface of the base plate 62 in a length direction thereof. In this embodiment, the electric heater elements $R_1$ and $R_2$ have identical electric resistance values, and the electric heater elements $R_3$ and $R_4$ have identical electric resistance values, which are greater than those of the heater elements $R_1$ and $R_2$.

The thermal line head 60 also comprises an integrated driver circuit pattern 64 and a grounded common terminal pattern 66, formed on the surface of the base plate 62, and the plural sets of four electric heater elements $R_1$, $R_2$, $R_3$ and $R_4$ are electrically connected to the driver circuit pattern 64 and the grounded common terminal pattern 66 via a wiring circuit pattern, generally indicated by reference numeral 68 in FIG. 10, formed on the surface of the base plate 62. Note, the patterns 64, 66 and 68, formed on the surface of the base plate 12, may be obtained by using photolithography.

Figure 11:
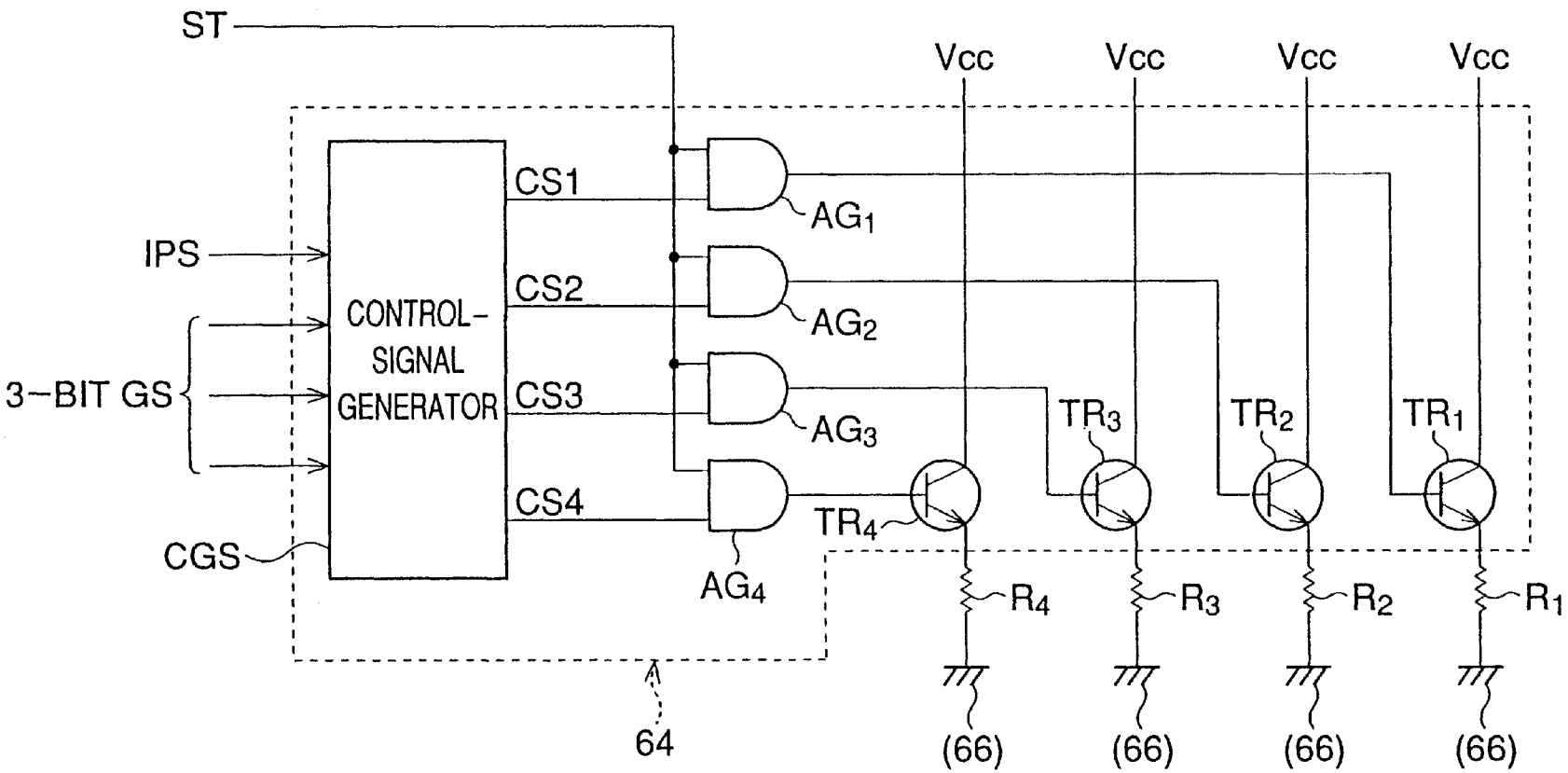
FIG. 11 is a schematic partial block diagram of an integrated driver circuit pattern formed on a surface of the thermal line head shown in FIG. 10.

With respect to each set of four electric heater elements $R_1$, $R_2$, $R_3$ and $R_4$, the driver circuit pattern 64 is provided with a set of four AND-gate circuits, a set of four transistors, and a control-signal generator. With reference to FIG. 11, the four respective AND-gate circuits in one set are indicated by references $AG_1$, $AG_2$, $AG_3$ and $AG_4$; the four respective transistors in one set are indicated by $TR_1$, $TR_2$, $TR_3$ and $TR_4$; and the control-signal generator is indicated by reference CSG.

When the thermal line head 60 is assembled in an ink transfer printer, as partially shown in FIG. 12, (which will be referred to as a second embodiment of the ink transfer printer according to the second aspect of the present invention, hereinafter), the driver circuit pattern 64 is electrically connected to a printer controller of the ink transfer printer (not shown). The printer controller outputs a strobe signal "ST", a digital image-pixel signal "IPS", and a digital 3-bit gradation-signal "GS" to the driver circuit pattern 64, in accordance with a series of digital image-pixel signals.

As shown in FIG. 11, the strobe signal "ST" is inputted to one of the two input terminals of each AND-gate circuit ($AG_1$, $AG_2$, $AG_3$, $AG_4$), and the digital image-pixel signal "IPS" and the digital 3-bit gradation-signal "GS" are inputted to the control-signal generator CSG, from which four control signals "CS1", "CS2", "CS3" and "CS4" are outputted. The respective control signals "CS1", "CS2", "CS3" and "CS4" are inputted to the other input terminals of the AND-gate circuits $AG_1$, $AG_2$, $AG_3$ and $AG_4$. Respective bases of the transistors $TR_1$, $TR_2$, $TR_3$ and $TR_4$ are connected to the output terminals of the AND-gate circuits $AG_1$, $AG_2$, $AG_3$ and $AG_4$; respective collectors of the transistors $TR_1$, $TR_2$, $TR_3$ and $TR_4$ are connected to electric power sources ($V_{cc}$); and respective emitters of the transistors $TR_1$, $TR_2$, $TR_3$ and $TR_4$ are connected to the electric heater elements $R_1$, $R_2$, $R_3$ and $R_4$.

As mentioned above, FIG. 12 shows the second embodiment of the ink transfer printer, according to the second aspect of the present invention, in which the thermal line head 60 is incorporated as one element thereof.

Figure 13:
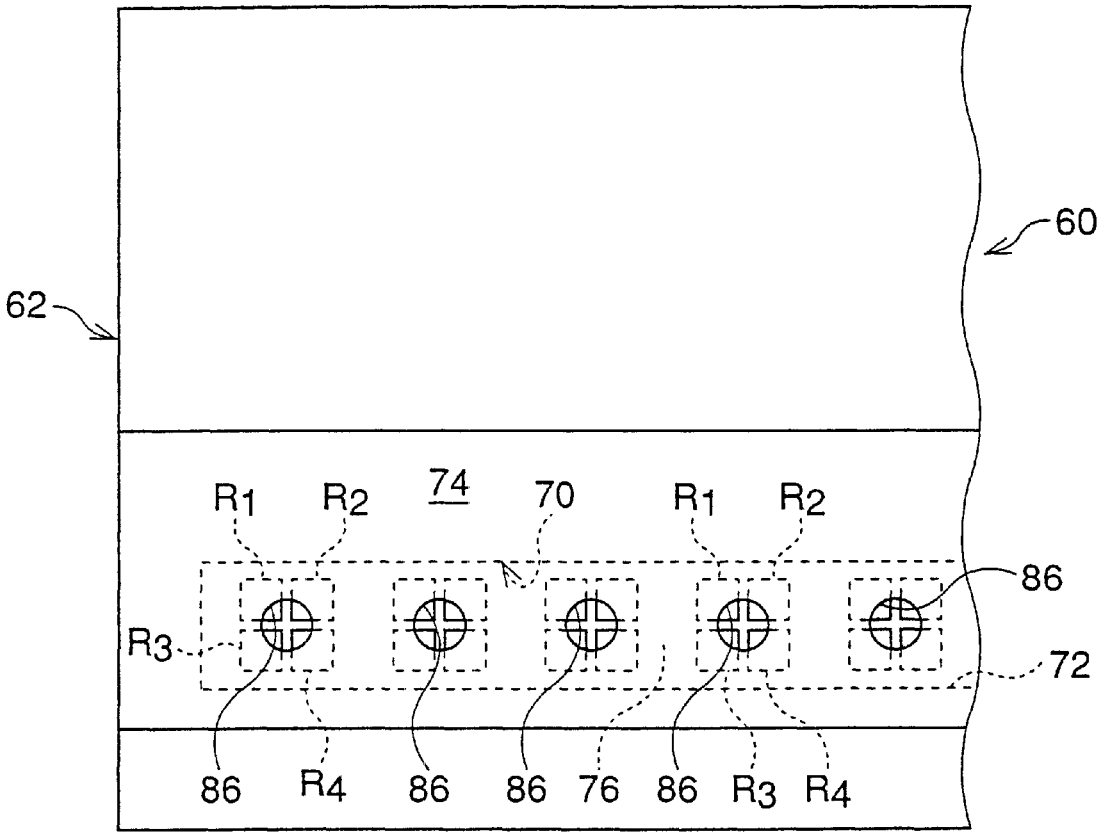
FIG. 13 is a schematic partial plan view, similar to FIG. 10, of the thermal line head incorporated in the ink transfer printer shown in FIG. 12.

The printer comprises an elongated rectangular frame member 70 securely provided on the thermal line head 60, and the frame member 70 is substantially identical to the frame member 38 of the first embodiment of the ink transfer printer. Namely, the frame member 70 is formed with an elongated rectangular opening 72 extending in a length direction thereof, and is placed on the circuit patterns 64, 66 and 68 such that the plural sets of four electric heater elements $R_1$, $R_2$, $R_3$ and $R_4$ are encompassed by the rectangular opening 72, as best shown in FIG. 13. Note, of course, the frame member 70 may be formed of a suitable electrical insulation material, exhibiting a non-permeability to a liquid ink.

Figure 12:
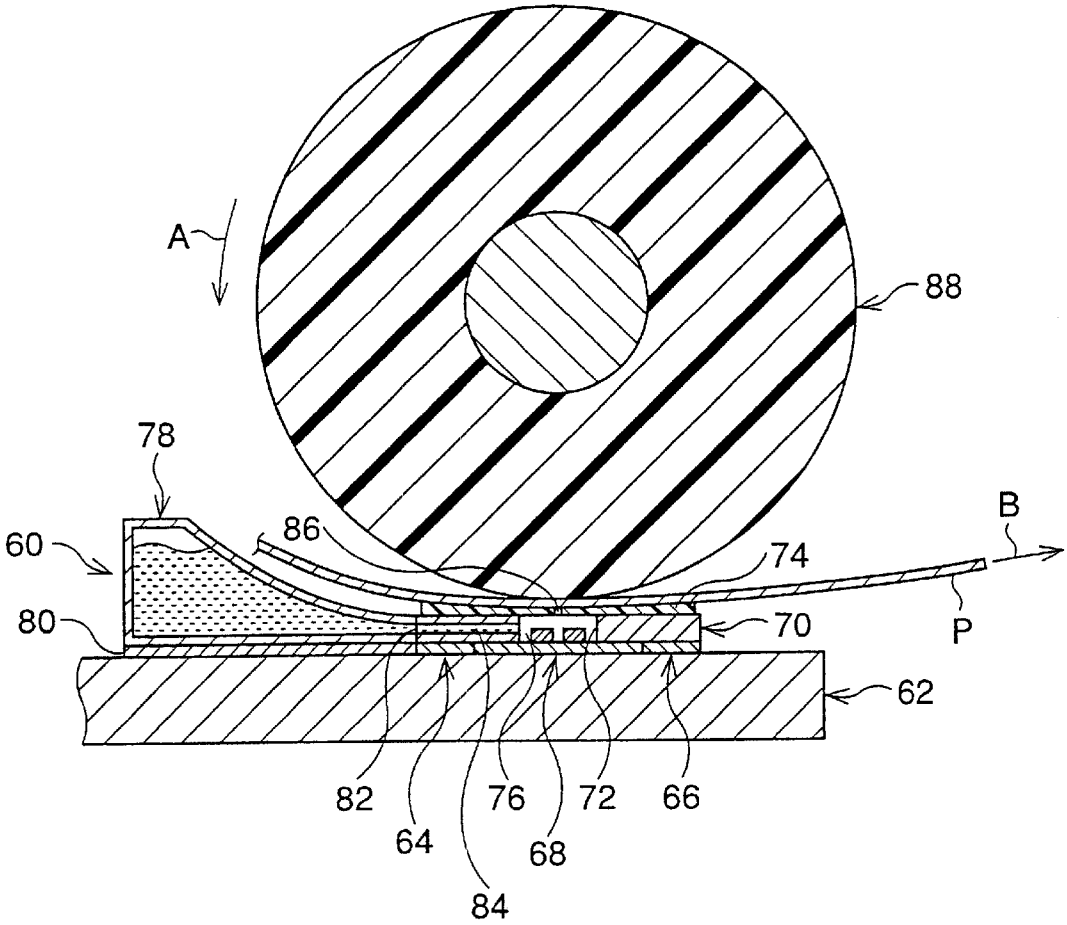
FIG. 12 is a schematic cross-sectional view of a second embodiment of an ink transfer printer according to the second aspect of the present invention.

The ink transfer printer also comprises a sheet of film 74 securely adhered to the frame member 70 such that the rectangular opening 72 is covered with the film sheet 74, thereby defining an ink space 76, as shown in FIG. 12. Similar to the first aspect of the present invention, there may be a gap of about 0.1 mm between the film sheet 74 and the surface of the thermal head 60, and a thickness of the film sheet 42 may be about 0.03 to about 0.08 mm.

The ink transfer printer further comprises an ink reservoir 78 securely mounted on the base plate 62 by using a suitable adhesive 80, and the ink reservoir 78 has an elongated spout 82 formed therein. The elongated spout 82 is securely joined to a wide capillary passage 84, formed in and extending along one of the longitudinal sides of the frame member 70, such that the ink reservoir 78 is in communication with the ink space 76 via the wide capillary passage 84. Thus, a liquid ink, held in the ink reservoir 78, can be drawn into the ink space 76, due to capillary action of the wide capillary passage 78. Namely, the ink space 76 is fed and filled with the liquid ink from the ink reservoir 78.

As shown in FIG. 13, the film sheet 74 is provided with a plurality of pores 86 formed therein. In this embodiment, the pores 86 are aligned with each other in a single row, and extend above the alignment of the electric heater elements $R_1$, $R_2$, $R_3$ and $R_4$. Each of the pores 86 of the film sheet 74 is associated with a set of four heater elements $R_1$, $R_2$, $R_3$ and $R_4$, operating in conjunction so as to produce a single ink dot. Note, similar to the first aspect of the present invention, although the pores 86 are exaggeratively illustrated in FIG. 13, in reality, the pores 86 are microscopic. Also note, the film sheet 74 may be produced in substantially the same manner as the film sheet 42 according to the first aspect of the present invention.

As shown in FIG. 12, the ink transfer printer further comprises a platen roller 88 constituted as a rubber roller, and the platen roller 88 is rotatably provided above and in contact with the film sheet 74, parallel to the alignment of the plural sets of four electric heater elements $R_1$, $R_2$, $R_3$ and $R_4$. The platen roller 88 is rotated, in a direction indicated by an arrow A in FIG. 12, with a suitable electrical motor (not shown). During the rotation of the platen roller 88, a sheet of recording paper P, introduced into a nip between the film sheet 74 and the platen roller 88, is subjected to a traction force from the rotating platen roller 88, and thus the recording paper sheet P is moved in a direction indicated by an arrow B in FIG. 12.

Figure 14:
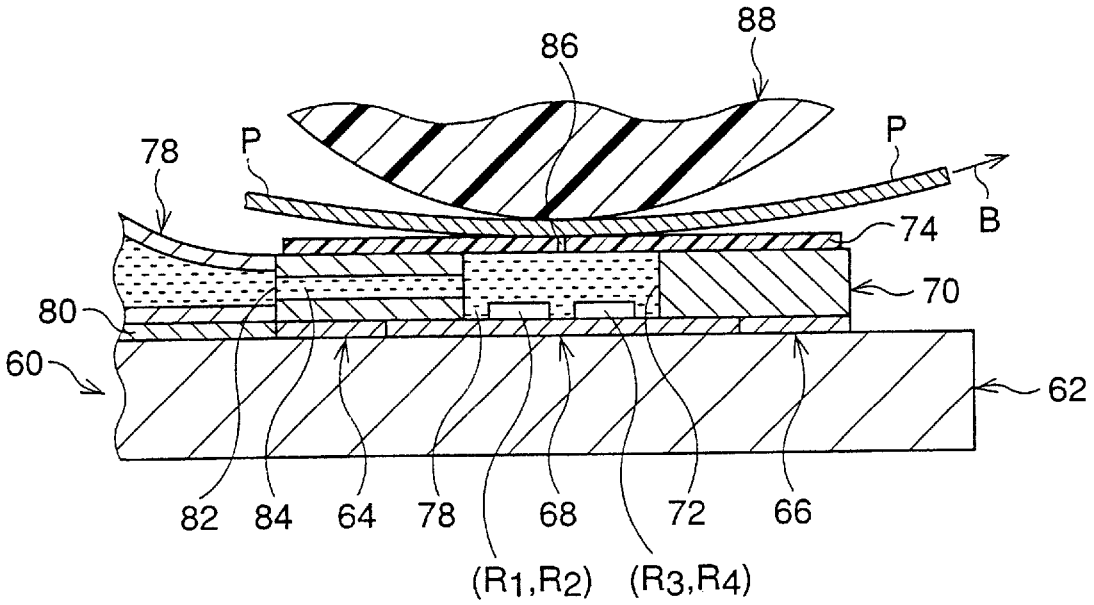
FIG. 14 is a schematic partially-enlarged cross-sectional view of the ink transfer printer, shown in FIG. 12, for explaining a principle of a printing operation, according to the second aspect of the present invention.
Figure 15:
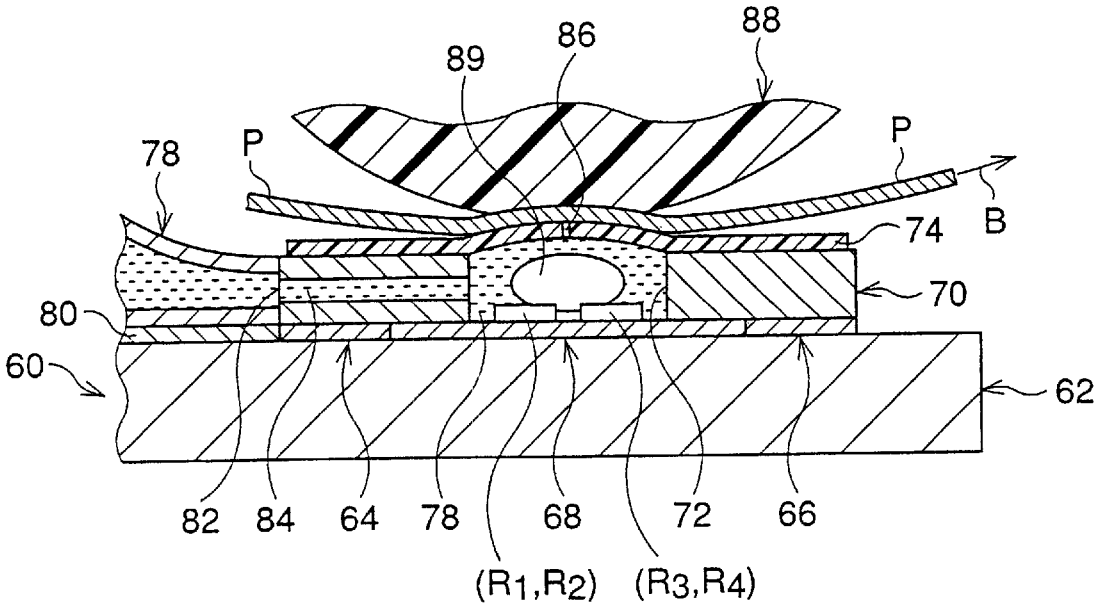
FIG. 15 is a schematic partially-enlarged cross-sectional view, similar to FIG. 14, showing the ink transfer printer concerned during the printing operation.

With reference to FIGS. 14 and 15, a principle of a printing operation, as performed by the ink transfer printer according to the second aspect of the present invention, is conceptually illustrated.

An elongated central area of the film sheet 74, in which the pores 86 are formed, is usually located in extremely close proximity to the alignment of the plural set of four electric heater elements $R_1$, $R_2$, $R_3$ and $R_4$, as shown in FIG. 14, or is in actual contact with the electric heater elements $R_1$, $R_2$, $R_3$ and $R_4$. When four electric heater elements $R_1$, $R_2$, $R_3$ and $R_4$ in one set are selectively energized and heated in accordance with an image-pixel signal "IPS" and a 3-bit gradation-signal "GS" (FIG. 11), as stated in detail hereinafter, a part of the ink surrounding these heater elements is vaporized, thereby producing a bubble 89, as shown in FIG. 15. Also, a local area of the film sheet 74, corresponding to the electric heater elements $R_1$, $R_2$, $R_3$ and $R_4$, is heated so that a modulus of elasticity of the heated local area decreases. As a result, the heated local area of the film sheet 74 inflates due to the decrease in the modulus of elasticity thereof and due to a vapor pressure generated in the bubble 89. Further, a part of the ink, pressurized by the vapor pressure, can permeate and penetrate into the pore 86, which is associated with the inflated local area of the film sheet 74, and thus the pore 86 is widened.

Thus, similar to the first aspect of the present invention, the permeated and penetrated ink appears as a fine ink drop on the inflated local area of the film sheet 74. Namely, the fine ink drop is transferred to the recording paper sheet P interposed between the film sheet 74 and the platen roller 88, and the transferred fine ink drop produces a single dot on the paper sheet P.

According to the second aspect of the present invention, as mentioned above, the four electric heater elements $R_1$, $R_2$, $R_3$ and $R_4$ in one set are selectively energized in accordance with an image-pixel signal "IPS" and a 3-bit gradation-signal "GS", and thus a size (diameter) of a single ink dot to be recorded on the paper sheet can be stepwisely adjusted, thereby obtaining a variation in density (gradation) of the single ink dot.

In particular, the control-signals "CS1", "CS2", "CS3" and "CS4" are varied in accordance with values of a digital image-pixel signal "IPS" and a digital 3-bit gradation-signal "GS", as shown in the following table:

| IPS | 3-BIT GS | CS1 | CS2 | CS3 | CS4 | ST | mJ/dot |
|---|---|---|---|---|---|---|---|
| [0] | | L | L | L | L | H | 0.0 |
| [1] | [000] | H | L | L | L | H | 0.1 |
| [1] | [001] | H | H | L | L | H | 0.2 |
| [1] | [010] | L | L | H | L | H | 0.3 |
| [1] | [011] | H | L | H | L | H | 0.4 |
| [1] | [100] | H | H | H | L | H | 0.5 |
| [1] | [101] | L | L | H | H | H | 0.6 |
| [1] | [011] | H | L | H | H | H | 0.7 |
| [1] | [111] | H | H | H | H | H | 0.8 |

Namely, when the digital image-pixel signal "IPS" has a value "0", all of the control-signals "CS1", "CS2", "CS3" and "CS4" are maintained at a low-level "L", regardless of values of the 3-bit gradation-signal "GS", and thus outputs of all of the AND-gate circuits $AG_1$, $AG_2$, $AG_3$ and $AG_4$ are at a low-level. Thus, none of the electric heater elements $R_1$, $R_2$, $R_3$ and $R_4$ are electrically energized.

On the other hand, when the digital image-pixel signal "IPS" has a value "1", at least one of the control-signals "CS1", "CS2", "CS3" and "CS4" exhibits a high-level pulse "H" having the same pulse width as that of the strobe signal "ST", in accordance with a value of the 3-bit gradation-signal "GS". For example, when the value of the 3-bit gradation-signal "GS" is [000], only the control signal "CS1" exhibts the high-level pulse "H", and the remaining control signals "CS2", "CS3" and "CS4" are maintained at the low-level "L". Thus, only the electric heater element "R", is electrically energized, thereby producing thermal energy of, for example, 0.1 mJ.

Also, for example, when the digital image-pixel signal "IPS" has the value "1", and when the value of the 3-bit gradation signal "GS" is [001], only the control signals "CS1" and "CS2" exhibit the high-level pulse "H", and the remaining control signals "CS3" and "CS4" are maintained at the low-level "L". Thus, only the electric heater elements $R_1$ and $R_2$ are electrically energized, thereby producing a total thermal energy output of 0.2 mJ, because these heater elements $R_1$ and $R_2$ have the same electric resistance value, as mentioned above.

Further, for example, when the digital image-pixel signal "IPS" has the value "1", and when the value of the 3-bit gradation signal "GS" is [010], only the control signal "CS3" exhibits the high-level pulse "H", and the remaining control signals "CS1", "CS2" and "CS4" are maintained at the low-level "L". Thus, only the electric heater element $R_3$ is electrically energized, thereby producing thermal energy of, for example, 0.3 mJ.

Also, for example, when the digital image-pixel signal "IPS" has the value "1", and when the value of the 3-bit gradation signal "GS" is [101], only the control signals "CS3" and "CS4" exhibit the high-level pulse "H", and the remaining control signals "CS1" and "CS2" are maintained at the low-level "L". Thus, only the electric heater elements $R_3$ and $R_4$ are electrically energized, thereby producing a total thermal energy output of 0.6 mJ, because these heater elements $R_3$ and $R_4$ have the same electric resistance value, as mentioned above.

In short, as is apparent from the previous table, one of the nine available thermal energy outputs (0.0, 0.1, 0.2, 0.7 and 0.8 mJ) is produced by selectively energizing the electric heater elements $A_1$, $R_2$, $R_3$ and $R_4$ in accordance with the digital image-pixel signal "IPS" and the 3-bit gradation-signal "GS". Of course, the size (diameter) of an ink dot to be recorded is stepwisely adjusted in accordance with the variation of thermal energy produced, due to the selective energization of the heater elements $R_1$, $R_2$, $R_3$ and $R_4$, enabling a variation in density (gradation) of the ink dot. Note, when all of the four electric heater elements $R_1$, $R_2$, $R_3$ and $R_4$ in one set are energized, i.e. when the maximum thermal energy of 0.8 mJ is produced, a recorded ink dot may have a size (diameter) of about 50 $\mu$m to about 100 $\mu$m. Also, note, when only one of the electric heater element $R_1$ is energized, a recorded ink dot has the smallest size (diameter).

In the second embodiment of the ink transfer printer according to the first aspect of the present invention, although the film sheet 74 has the pores 86 regularly aligned with each other in a single row, the pores 86 may be aligned with each other in two rows, as with the first aspect of the present invention, or a multitude of microscopic pores may be randomly and homogeneously distributed over an elongated central area of the film sheet 74, in place of the aligned pores 86.

Figure 16:
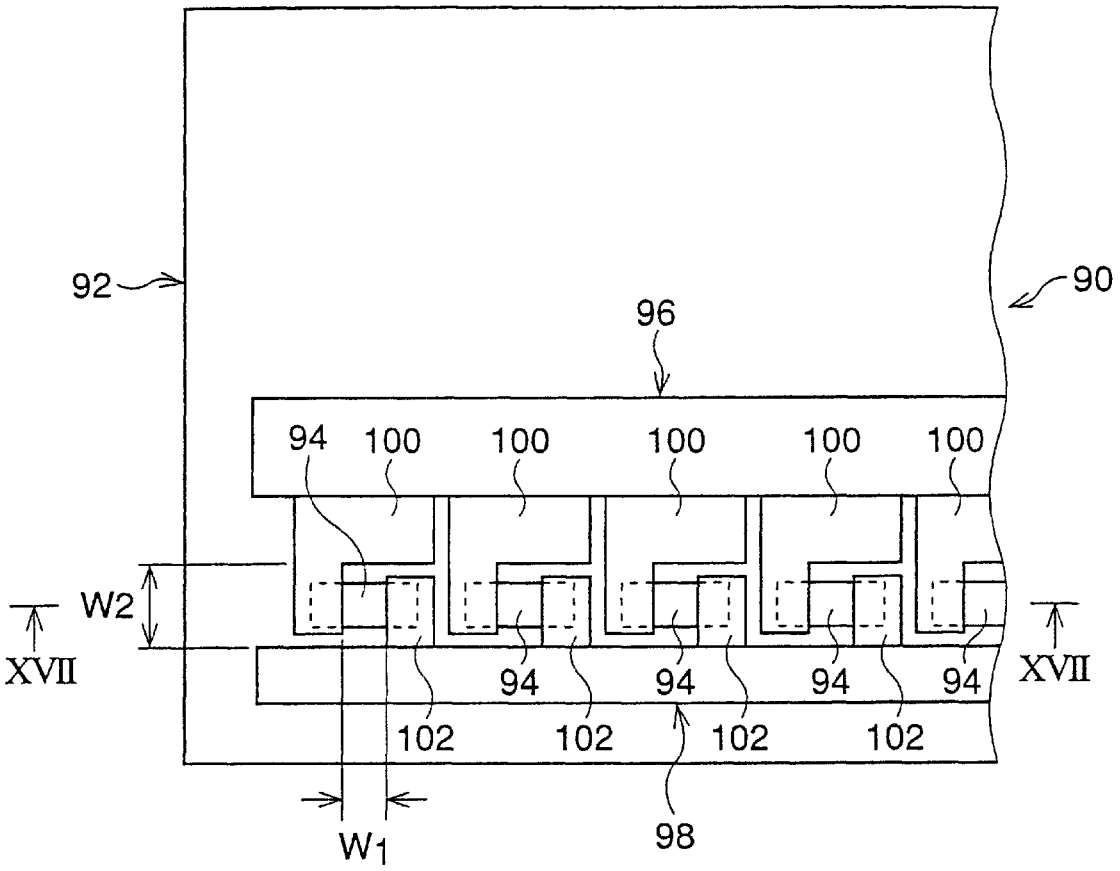
FIG. 16 is a schematic partial plan view showing a third embodiment of a thermal line head, according to a third aspect of the present invention.
Figure 17:
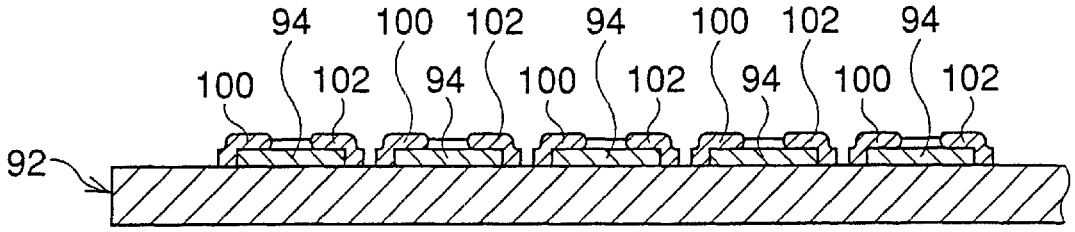
FIG. 17 is a cross-sectional view taken along a line XVII—XVII of FIG. 16.

FIGS. 16 and 17 show a thermal line head, generally indicated by reference numeral 90, according to a third aspect of the present invention, which will be referred to as a third embodiment of the thermal line head.

In the third aspect of the present invention, the thermal line head 90 comprises an elongated rectangular base plate 92 formed of a suitable ceramic material, and a plurality of electric resistance elements or electric heater elements 94 aligned on a surface of the base plate 92 in a length direction thereof. As shown in FIG. 16, each of the electric heater elements 94 is formed as a small rectangular strip, axially oriented in the length direction of the base plate 92.

The thermal line head 90 also comprises an integrated driver circuit pattern 96 and a grounded common terminal pattern 98, formed on the surface of the base plate 92, and each of the electric heater elements 94 is electrically connected to the driver circuit pattern 96 and the grounded common terminal pattern 98 via a set of first and second electrode patterns 100 and 102 formed on the surface of the base plate 92. These patterns 96, 98, 100 and 102, formed on the surface of the base plate 92, may be obtained by using photolithography. Note, similar to the first aspect of the present invention, the driver circuit pattern 96 may be arranged as shown in FIG. 2.

As shown in FIG. 16, each of the first electrode patterns 100 is formed as a generally L-shaped pattern, an arm section of which is electrically connected to one end of a corresponding electric heater element 94. On the other hand, each of the second electrode patterns 102 is formed as a rectangle, and is electrically connected to the other end of the corresponding electric heater element 94. Namely, a heat-generating area of each electric heater element 94 is defined by the corresponding first and second electrode patterns 100 and 102, and may have a width W1 of about 30 $\mu$m to about 50 $\mu$m as shown in FIG. 16. On the other hand, there may be a width W2 of about 50 $\mu$m to about 70 $\mu$m between opposite edges of the grounded common terminal pattern 98 and the other arm section of the L-shaped electrode pattern 100. In short, the heat-generating area of each electric heater element 94 is surrounded by four edges from the patterns 98, 100 and 102, as shown in FIG. 16. Note, as shown in FIG. 17 taken along a line XVII—XVII of FIG. 16, a thickness of the patterns 98, 100 and 102 is somewhat larger than that of the electric heater elements 94.

Figure 18:
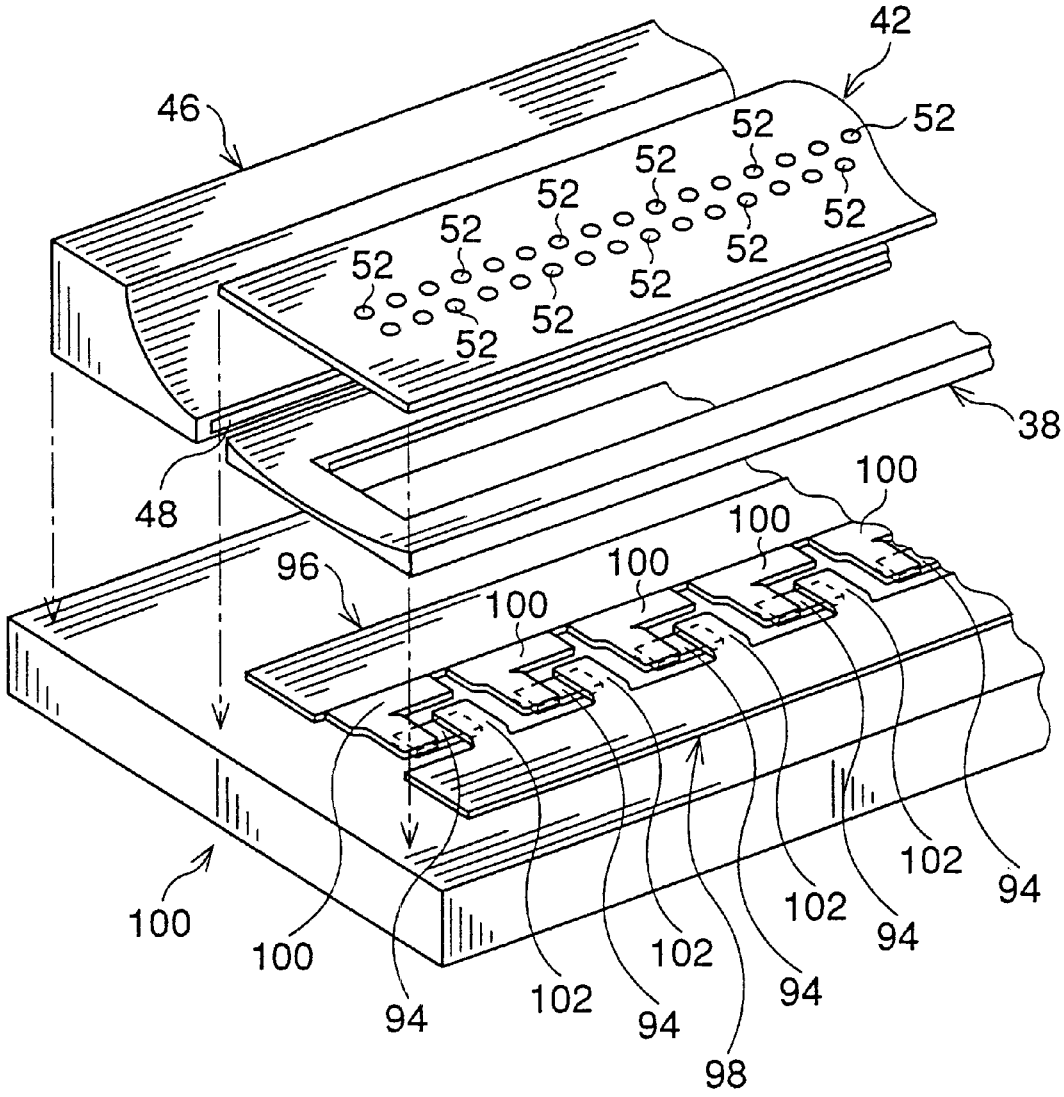
FIG. 18 is a schematic perspective exploded view of a third embodiment of an ink transfer printer according to the third aspect of the present invention.
Figure 19:
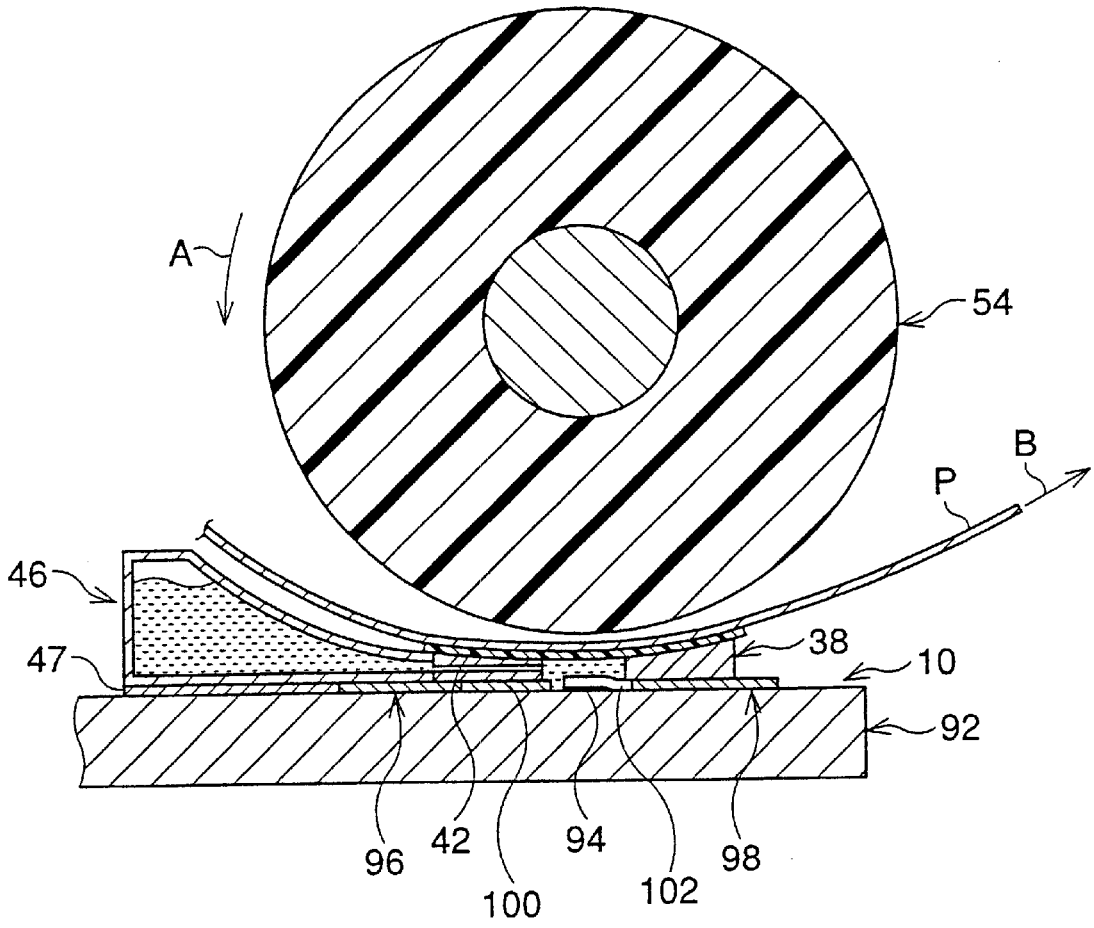
FIG. 19 is a schematic cross-sectional view of the third embodiment of the ink transfer printer shown in FIG. 18.

FIGS. 18 and 19 show an ink transfer printer, according to the third aspect of the present invention, which will be referred to as a third embodiment of the ink transfer printer, and in which the above-mentioned thermal line head 90 is incorporated as one element of the ink transfer printer.

The third embodiment of the ink transfer printer is substantially identical to the first embodiment of the ink transfer printer except that the thermal line head 90 is substituted for the thermal line head 10. Thus, in FIGS. 18 and 19, the features similar to those of FIGS. 6 and 7 are indicated by the same reference numerals.

Figure 20:
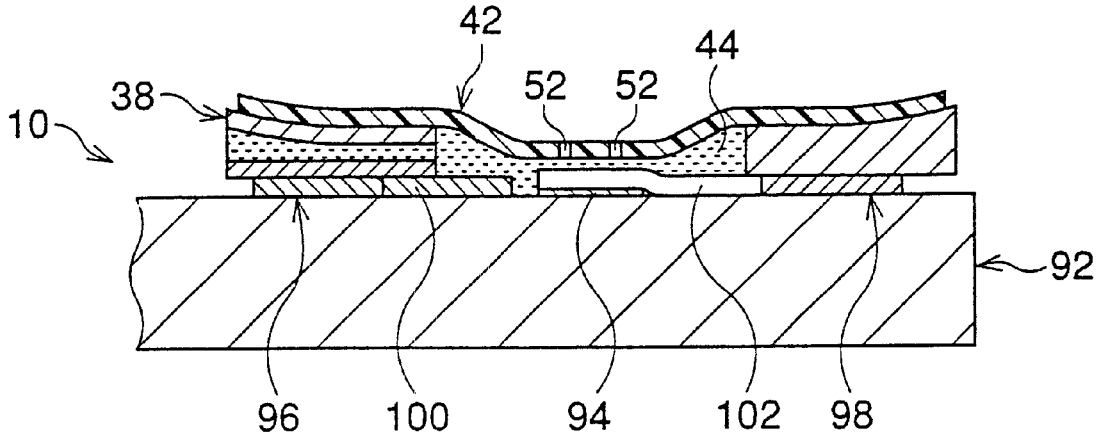
FIG. 20 is a schematic partially-enlarged cross-sectional view of the ink transfer printer, shown in FIG. 19, for explaining a principle of a printing operation, according to the third aspect of the present invention.
Figure 21:
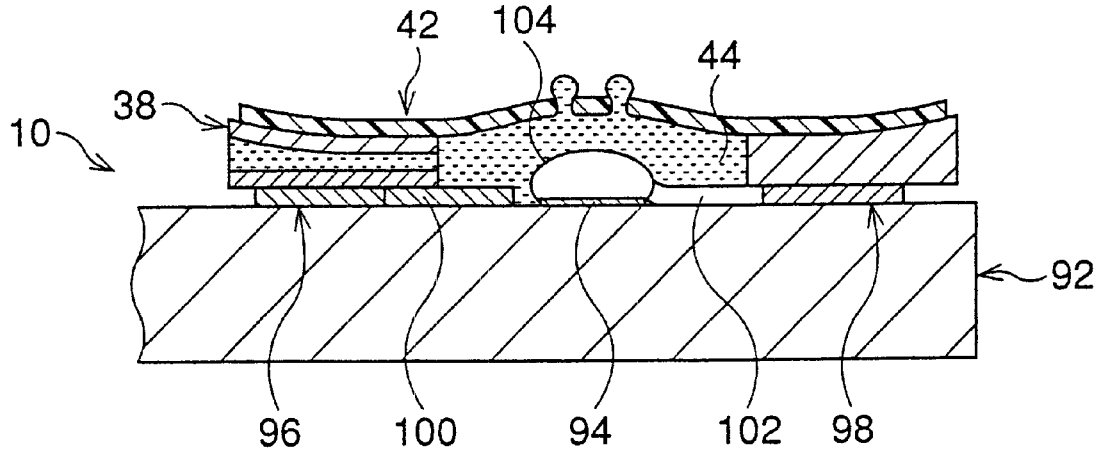
FIG. 21 is a schematic partially-enlarged cross-sectional view, similar to FIG. 20, showing the ink transfer printer concerned during the printing operation.

With reference to FIGS. 20 and 21, a principle of a printing operation, as performed by the ink transfer printer according to the third aspect of the present invention, is conceptually illustrated.

Similar to the first aspect of the present invention, an elongated central area of the film sheet 42, in which the pores 52 are formed, is usually located in extremely close proximity to the electric heater elements 94, as shown in FIG. 20, or is in actual contact with the electric heater elements 94. When one of the electric heater elements 94 is heated by an electrical energization thereof, the electric heater element 94 concerned is heated to a predetermined temperature.

Thus, a part of the ink, in contact with the heated heater element 94, is vaporized, thereby producing a bubble 104, as shown in FIG. 21. Also, a local area of the film sheet 42, corresponding to the heated heater element 94, is heated so that a modulus of elasticity of the heated local area decreases. As a result, the heated local area of the film sheet 42 inflates due to the decrease in the modulus of elasticity thereof and the vapor pressure generated in the bubble 104. Further, a part of the ink, pressurized by the vapor pressure, can permeate and penetrate into the pores 52, which are included in the inflated local area of the film sheet 42, and thus these pores 52 are widened.

Namely, the principle of a printing operation, preformed by the ink transfer printer according to the third aspect of the present invention, is substantially identical to that of the first aspect of the present invention. Nevertheless, the ink transfer printer, according to the third aspect of the present invention, has excellent energy efficiency, because of the effective use of the vapor pressure and the thermal energy, captured in the heat-generating area of the heater element 94 surrounded by the four edges of the patterns 98, 100 and 102, acting on the immediately surrounding ink.

Figure 22:
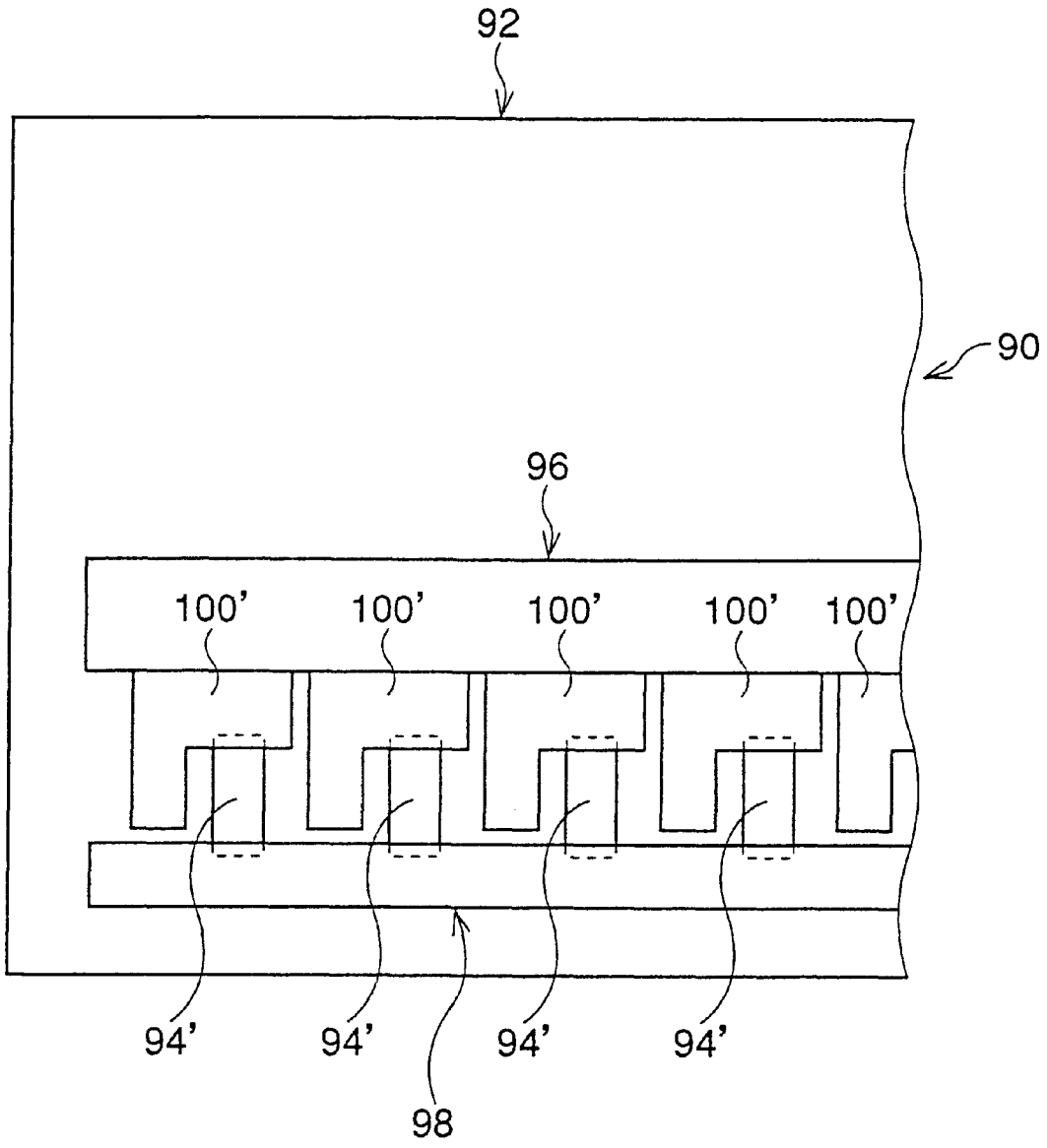
FIG. 22 is a schematic partial plan view showing a modification of the third embodiment of the thermal line head, according to the third aspect of the present invention.

FIG. 22 shows a modification of the third embodiment of the thermal line head 90, shown in FIGS. 16 to 17. Note, in FIG. 22, the features similar to those of FIG. 16 are indicated by the same reference numerals. In this modified embodiment, a plurality of electric resistance elements or electric heater elements 94', which are formed as small rectangular strips, is aligned on a surface of an elongated rectangular base plate 92 in a length direction thereof. However, the electric heater elements 94' are perpendicularly oriented with respect to the length direction of the base plate 92.

Also, in the modified embodiment, each of the heater elements 94' is connected at one end to an integrated driver circuit pattern 96 via a generally L-shaped electrode pattern 100', and is directly connected at the other end to a grounded common terminal pattern 98. As shown in FIG. 22, an arm section of each of the generally L-shaped electrode patterns 100' extends in a length direction of a corresponding heater element 94', and both arm sections of two adjacent electrode patterns 100', in conjunction with the grounded common terminal pattern 98, surround the corresponding heater element 94'. Thus, similar to the third embodiment of the ink transfer painter, when an electric heater element is electrically energized and heated, an increase in vapor pressure and outputted thermal energy can be restricted to the surrounding area, and effectively exerted on a part of the immediately surrounding ink.

Figure 23:
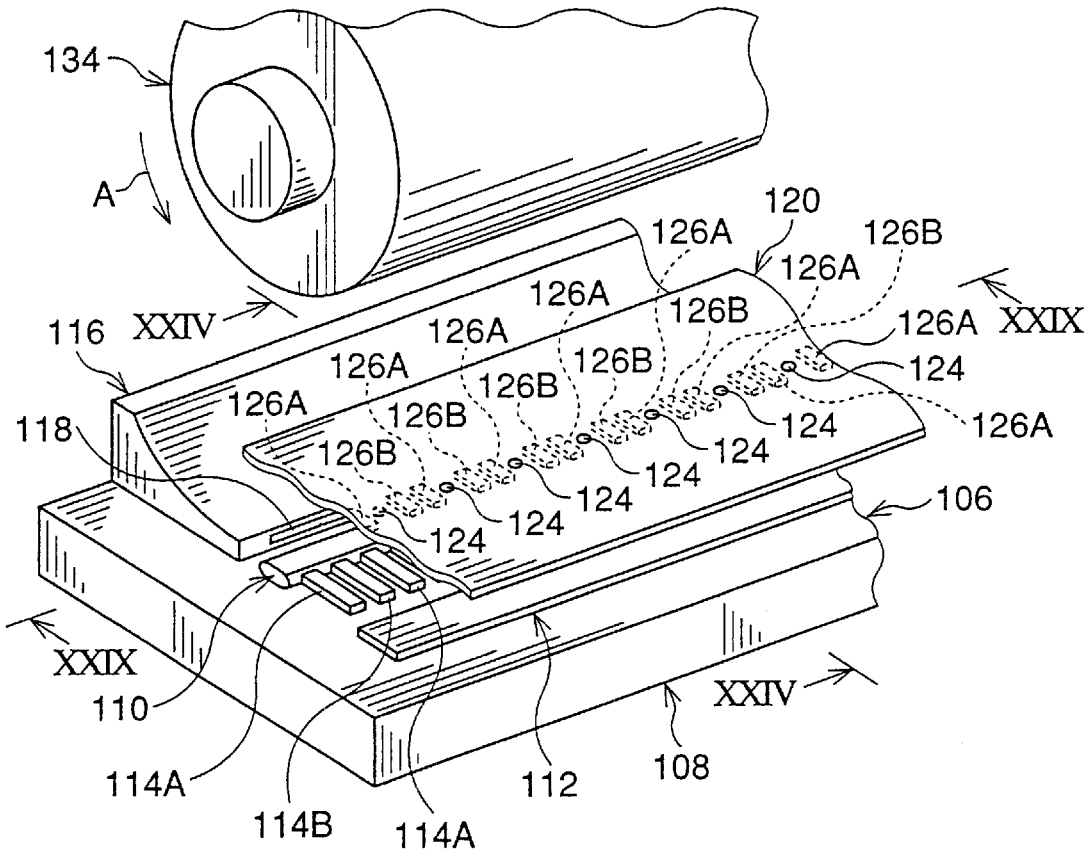
FIG. 23 is a schematic perspective exploded view of a fourth embodiment of an ink transfer printer according to a fourth aspect of the present invention.
Figure 24:
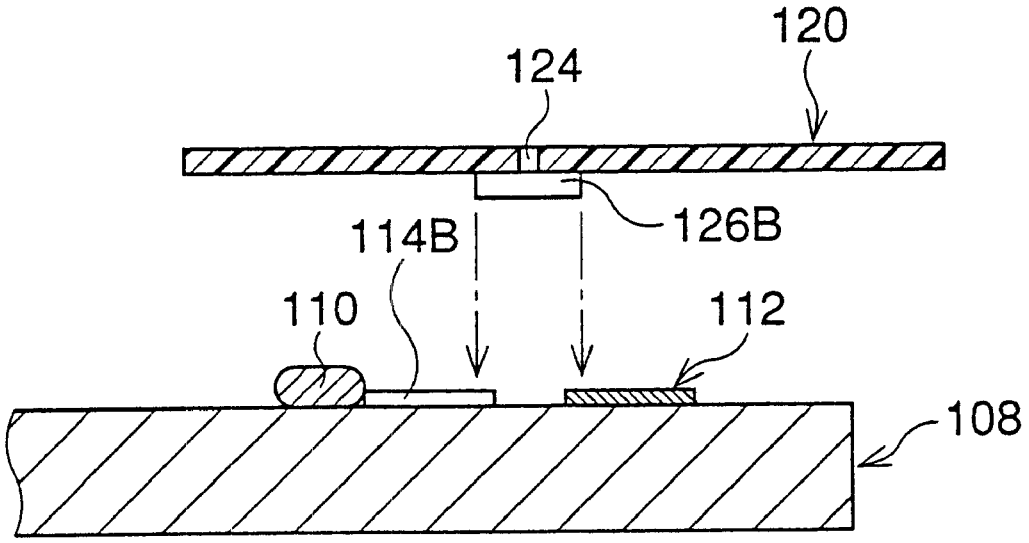
FIG. 24 is a partial cross-sectional view taken along a line XXIV—XXIV of FIG. 23.
Figure 25:
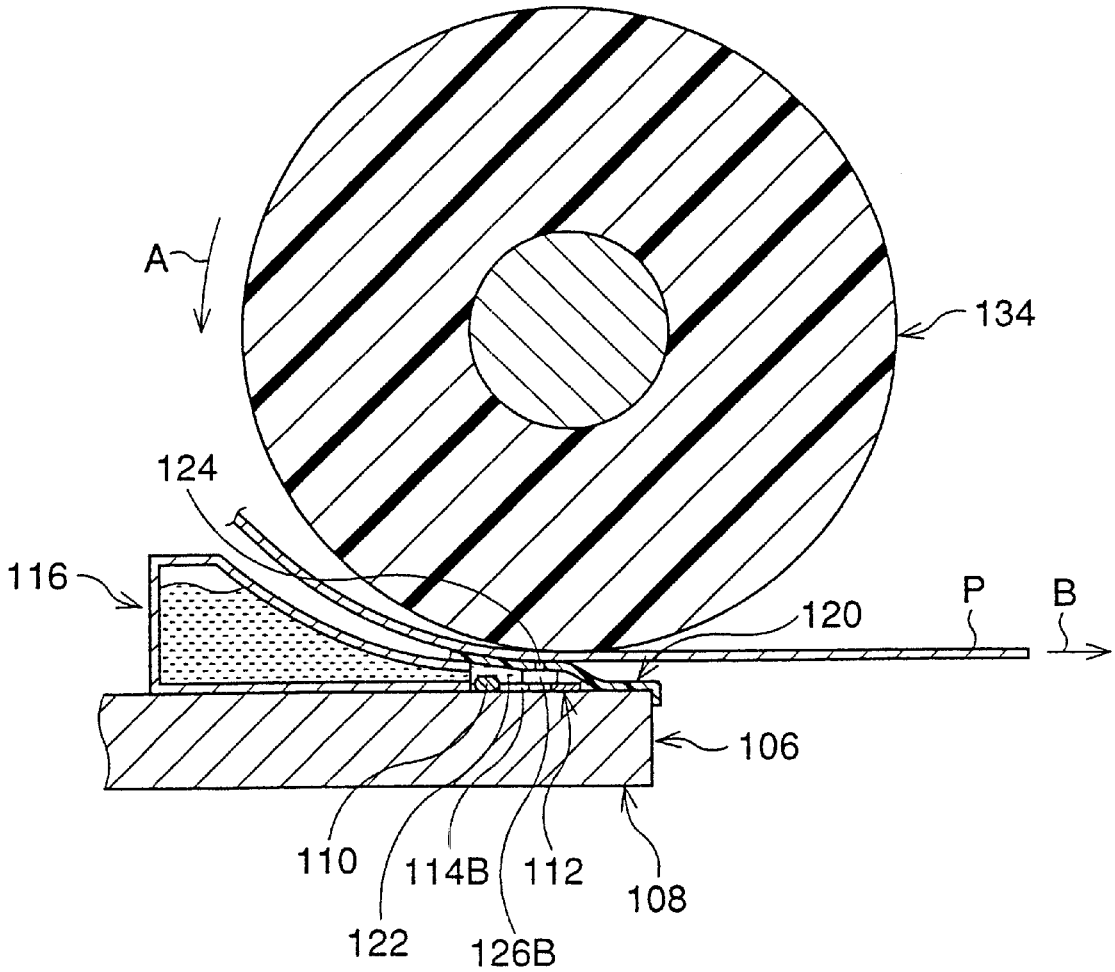
FIG. 25 is a schematic cross-sectional view of the fourth embodiment of the ink transfer printer shown in FIG. 23.

FIGS. 23, 24 and 25 show an ink transfer printer, according to a fourth aspect of the present invention, which will be referred to as a fourth embodiment of the ink transfer printer.

In this fourth embodiment, the ink transfer printer is provided with a thermal line head 106, which comprises an elongated rectangular base plate 108 formed of, for example, a suitable ceramic material, and an integrated driver circuit device 110 provided on a surface of the base plate 108. The thermal line head 106 also comprises a grounded common terminal pattern 112 and plural sets of electrode patterns 144A and 144B formed on the surface of the base plate 108, and it is possible to perform the formation of the patterns 112, 114A and 114B by photolithography. Each set of electrode patterns 114A and 114B is electrically connected to the driver circuit device 110.

The ink transfer printer is also provided with an ink reservoir 116, provided with an elongated spout 118 formed therein, securely mounted on the base plate 108 along the driver circuit device 110. As shown in FIG. 23, the ink transfer printer is further provided with an elongated sheet of film 120, which is partially provided over the surface of the base plate 108, such that the driver circuit device 110, the grounded common terminal pattern 112, the plural sets of electrode patterns 114A and 114B and the spout portion (118) of the ink reservoir 116 are covered with the film sheet 120, thereby defining an ink space 122 (FIG. 25). Namely, one of the longitudinal side edges of the sheet film 120 is securely adhered and sealed to the spout portion (118) of the ink reservoir 116, and the remaining side edges of the sheet film 120 are securely adhered and sealed to the surface of the base plate 108. The ink space 122 is fed and filled with a liquid ink from the ink reservoir 116.

Note, there may be a gap of about 0.1 mm between the film sheet 120 and the surface of the base plate 108, and a thickness of the film sheet 120, formed of, for example, polytetrafluoroethylene, may be about 0.03 to about 0.08 mm.

As best shown in FIG. 24 taken as along a line XXIV—XXIV of FIG. 23, the film sheet 120 has a plurality of pores 124 formed therein, and these pores 124 are aligned with each other in the length direction of the film sheet 120. Also, the film sheet 120 has plural sets of electric resistance elements or electric heater elements 126A and 126B securely attached to an inner surface thereof, and these plural sets of heater elements 126A and 126B are aligned with each other in the length direction of the film sheet 120, such that each of the pores 124 is positioned between the heater elements 126A and 126B in one set. When the film sheet 120 is provided over the surface of the base plate 108, each set of electric heater elements 126A and 126B is electrically connected to a corresponding one set of electrode patterns 114A and 114B and the grounded common terminal pattern 112 so as to form a bridge therebetween, as best shown in FIG. 24.

Figure 26:
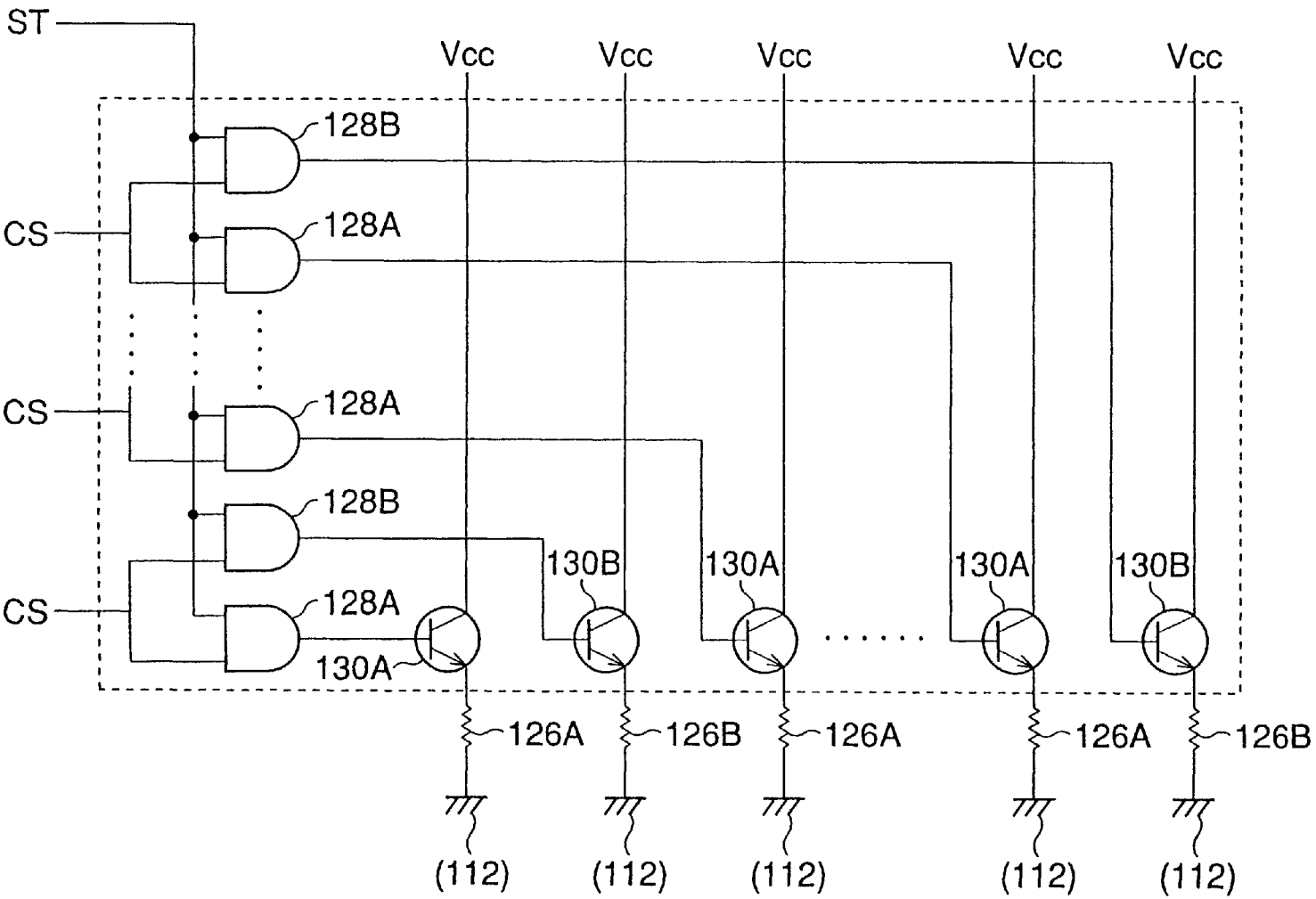
FIG. 26 is a schematic block diagram of an integrated driver circuit device provided on a surface of a thermal line head incorporated in the ink transfer printer of FIGS. 23, 24 and 25.

In the fourth embodiment of the ink transfer printer, the plural sets of electric heater elements 126A and 126B are selectively and electrically energized in accordance with a series of digital image-pixel signals. To this end, the driver circuit device 110 is arranged as shown in FIG. 26.

In particular, the driver circuit device 110 includes plural sets of AND-gate circuits 128A and 128B and plural sets transistors 130A and 130B associated with the respective plural sets of electric heater elements 126A and 126B. As shown in FIG. 26, a strobe signal "ST" is inputted to one of the two input terminals of each AND-gate circuit (128A, 128B) and a control signal "CS", derived from a single digital image-pixel signal, is inputted to the other of the input terminals of the AND-gate circuits 128A and 128B in each set, to which the strobe signal "ST" is not inputted.

A base of each transistor (130A, 130B) is connected to an output terminal of a corresponding AND-gate circuit (128A, 128B); a collector of each transistor (130A, 130B) is connected to a corresponding electric power source ($V_{cc}$); and an emitter of each transistor (130A, 130B) is connected to a corresponding electrode pattern (114A, 114B), and therefore, to a corresponding electric heater element (126A, 126B).

The strobe signal "ST" has a predetermined pulse width. However, the control signal "CS" varies in accordance with binary values of a single digital image-pixel signal. Namely, when the digital image-pixel signal has a value "1", the control signal "CS" exhibits a high-level pulse having the same pulse width as that of the strobe signal "ST", whereas, when the digital image-pixel signal has a value "0", the control signal "CS" is maintained at a low-level.

Accordingly, when the digital image-pixel signal has the value "1", i.e. when the control signal "CS" exhibts the high-level pulse, both outputs of corresponding AND-gate circuits 128A and 128B in one set are changed from the low-level to the high-level, thereby turning ON corresponding transistors 130A and 130B in one set. Thus, corresponding electric heater elements 126A and 126B in one set are electrically energized during a period corresponding to the pulse width of the strobe signal "ST", whereby the electric heater elements 126A and 126B in one set concerned simultaneously produce thermal energy, resulting in the heating of the electric heater elements 126A and 126B in one set concerned to a predetermined temperature.

On the other hand, when the digital image-pixel signal has the value "0", i.e when the control signal "CS" is kept at the low-level, both outputs of the AND-gate circuits 128A and 128B in one set are also at a low-level, thereby maintaining the OFF condition of the corresponding transistors 130A and 130B in the one set. Thus, the corresponding electric heater elements 126A and 126B in the one set concerned are not electrically energized, whereby the corresponding electric heater elements 126A and 126B in the one set concerned cannot be heated.

As shown in FIGS. 23, and 25, the ink transfer printer further comprises a platen roller 134 constituted as a rubber roller, and the platen roller 134 is rotatably provided above and in contact with the film sheet 120, parallel the the alignment of the plural sets of electric heater elements 126A and 126B. The platen roller 134 is rotated, in a direction indicated by an arrow A in FIGS. 23 and 25, with a suitable electrical motor (not shown). During the rotation of the platen roller 134, a sheet of recording paper P, introduced into a nip between the film sheet 120 and the platen roller 134, is subjected to a traction force from the rotating platen roller 134, and thus the recording paper sheet P is moved in a direction indicated by an arrow B in FIG. 25.

Figure 27:
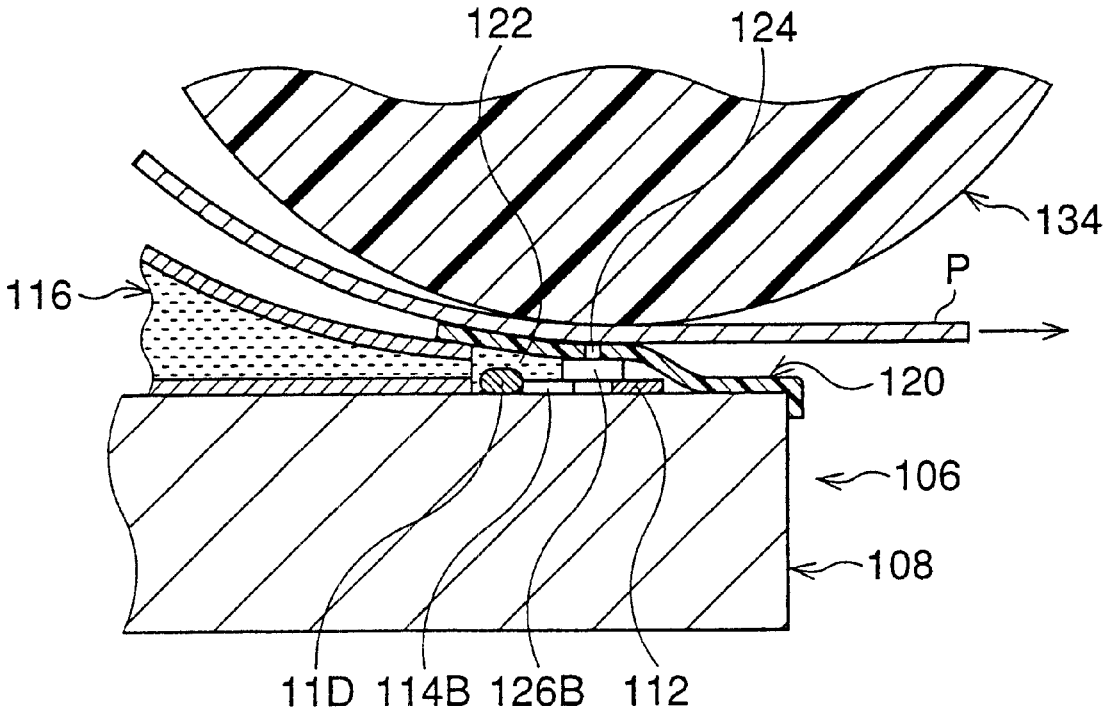
FIG. 27 is a schematic partially-enlarged cross-sectional view of the ink transfer printer, shown in FIG. 25, for explaining a principle of a printing operation, according to the fourth aspect of the present invention.
Figure 28:
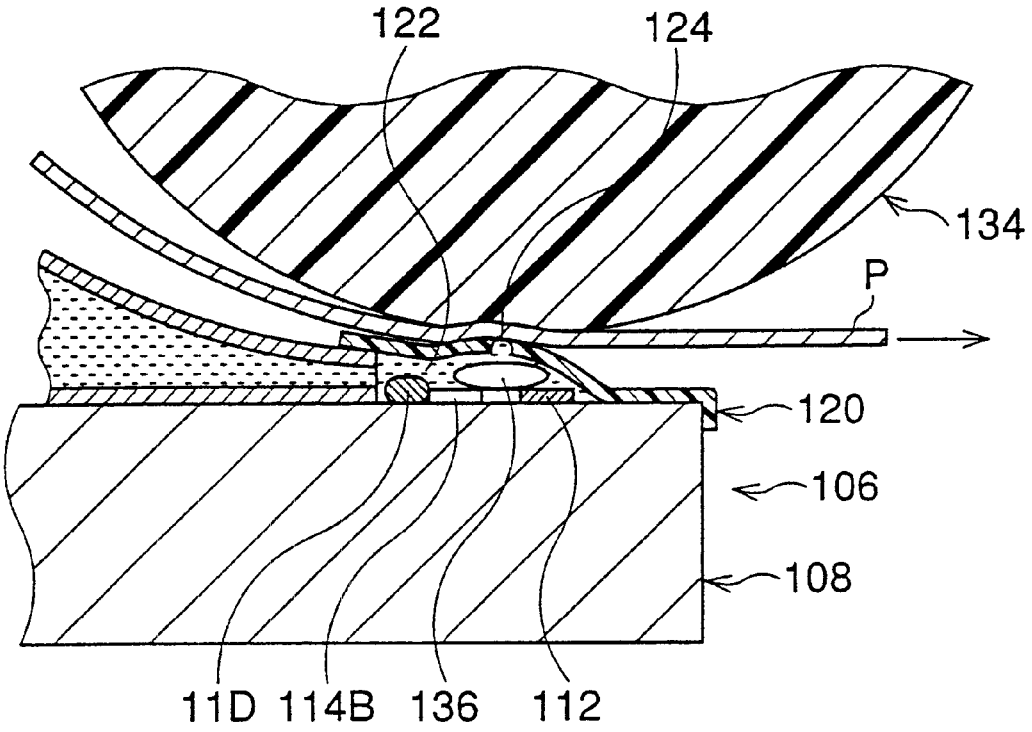
FIG. 28 is a schematic partially-enlarged cross-sectional view, similar to FIG. 27, showing the ink transfer printer concerned during the printing operation.
Figure 29:
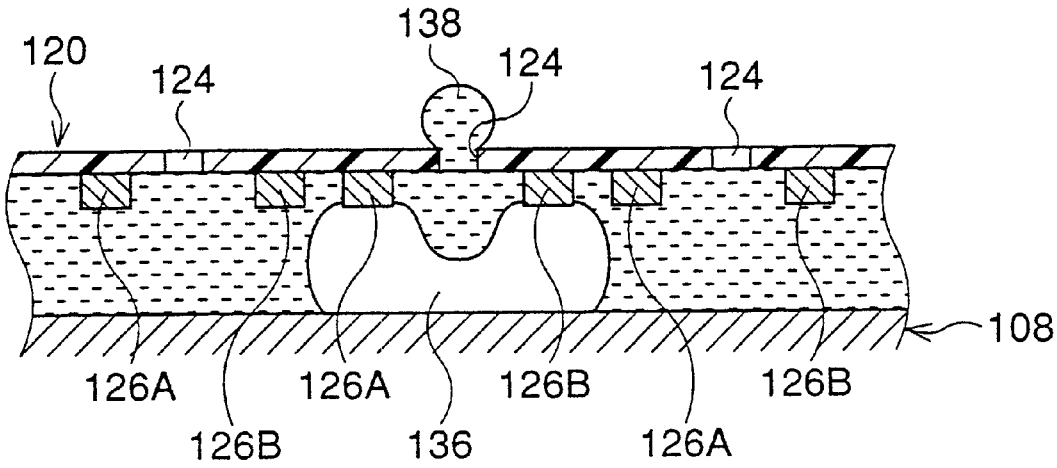
FIG. 29 is a longitudinal partial cross-sectional view, taken along a line XXIX—XXIX of FIG. 23, of the ink transfer printer during the printing operation.

With reference to FIGS. 27, 28 and 29, a principle of a printing operation, as performed by the ink transfer printer according to the fourth aspect of the present invention is conceptually illustrated.

When a set of heater elements 126A and 126B is heated by an electrical energization thereof, the heater elements 126A and 126B in the one set concerned are heated to a predetermined temperature. Thus, a part of the ink, in contact with the heated heater elements 126A and 126B, is vaporized, thereby producing a bubble 136, as shown in FIGS. 28 and 29 Also, a local area of the film sheet 120, existing between the heated heater elements 126A and 126B in the one set, is heated so that a modulus of elasticity of the heated local area decreases. As a result, the heated local area of the film sheet 120 inflates due to the decrease in the modulus of elasticity thereof and a vapor pressure generated in the bubble 120, as shown in FIG. 28. Further, a part of the ink, pressurized by the vapor pressure, can permeate and penetrate into the pore 124, which is included in the inflated local area of the film sheet 120, and thus the pore 124 is widened. Note, for the simplicity of illustration, the electric heater elements 126A and 126B are omitted from FIG. 28.

Accordingly, the permeated and penetrated ink appears as an ink drop 138 on the inflated local area of the film sheet 120, as shown in FIG. 29 taken along a line XXIX—XXIX of FIG. 23, and the ink drop 138 is transferred to the recording paper sheet P, so that a single dot is produced on the paper sheet P by the transferred ink drop 138.

In the fourth embodiment of the ink transfer printer according to the fourth aspect of the present invention, although only one pore 124 is formed in the area of the film sheet 120 between electric heater elements 126A and 126B in each set, there may be two or more than two pores in this area.

According to the fourth aspect of the present invention, during manufacture of the ink transfer printer, it is possible to easily perform an attachment of the film sheet 120 to the thermal line head 106, because a relative positioning of the plural sets of electric heater elements 126A and 126B to the alignment of the pores 124 has been previously completed, due to the plural sets of electric heater elements 126A and 126B being formed on the sheet film 120. Of course, as with the cases of the first, second and third aspects of the present invention, when a sheet of film, having an alignment of pores, is attached to a thermal head having an alignment of electric heater elements, the attachment of the sheet film to the thermal line head is very troublesome, because the alignment of the pores must be properly and precisely carried out with respect to the alignment of electric heater elements.

Figure 30:
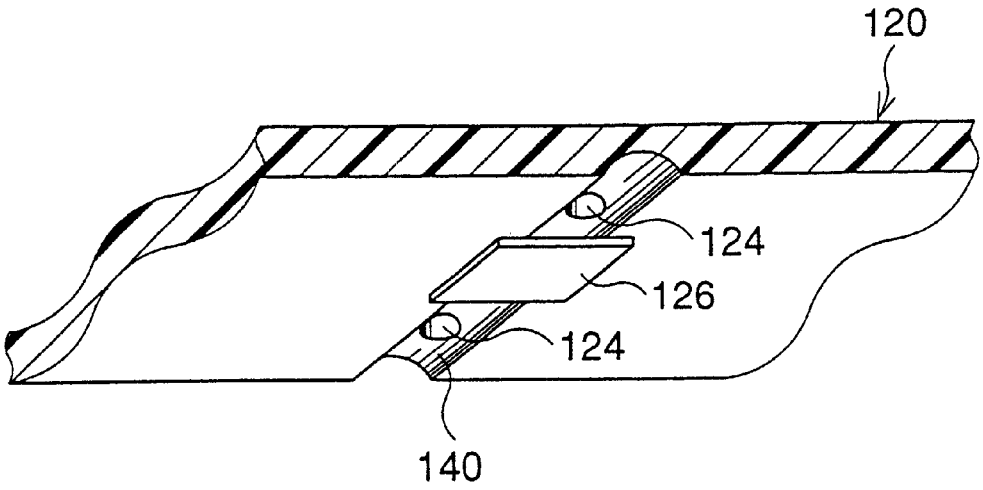
FIG. 30 is a schematic partial perspective view showing a modification of the fourth embodiment of the ink transfer printer.

FIG. 30 shows a modification of the fourth embodiment of the ink transfer printer according to the fourth aspect of the present invention. Note, in this drawing, the features similar to those of FIGS. 23 to 25 are indicated by the same reference numerals.

In this modified embodiment, an elongated sheet of film 120 is formed with an elongated fine groove 140 extending in a length direction of the film sheet 120, and plural pores 124 are formed in and arranged along the fine groove 140. Each of plural electric heater elements 126 is securely attached to an inner surface of the film sheet 120 so as to bridge the fine groove 140 at a location just below a corresponding pore 124. Namely, each of the pores 124 is allocated to and associated with a corresponding one of the plural electric heater elements 126. Accordingly, in this modified embodiment, with the plural electric heater elements 126, plural electrode patterns are correspondingly provided on a surface of an elongated rectangular base plate (108), in place of the plural sets of electrode patterns 114A and 114B. Also, in this modified embodiment, the plural electric heater elements 126 are selectively and electrically energized by an integrated driver circuit device, which is arranged in substantially the same manner as in FIG. 2. When an electric heater element 126 is energized and heated, a corresponding pore 124 is fed with ink through the fine groove 140.

Figure 31:
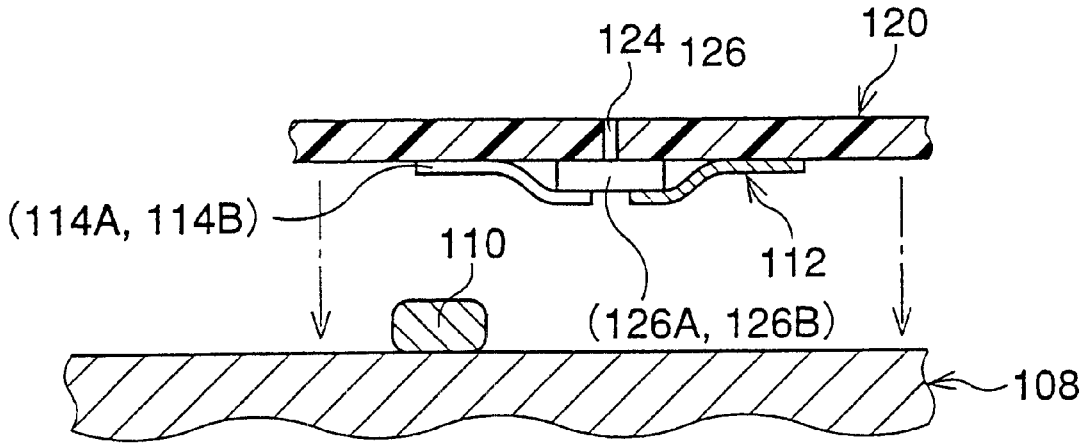
FIG. 31 is a partial cross-sectional view, corresponding to FIG. 24, showing another modification of the fourth embodiment of the ink transfer printer.

FIG. 31 shows another modification of the fourth embodiment of the ink transfer printer according to the fourth aspect of the present invention. Note, in this drawing, the features similar to those of FIGS. 23 to 25 are indicated by the same reference numerals.

In this modified embodiment, not only is an alignment of plural sets of electric heater elements 126A and 126B preformed, bat also a grounded common terminal pattern 112 and plural sets of electrode patterns 114A and 114B are previously formed on a rear surface of an elongated sheet of film 120. Accordingly, an attachment of the film sheet 120 to the thermal line head 106 can be more easily performed, due to the additional previous formation of the grounded common terminal pattern 112 and the plural sets of electrode patterns 114A and 114B on the film sheet 120. Note, the same modification can also be in included in the first-mentioned modification of FIG. 30.

Figure 32:
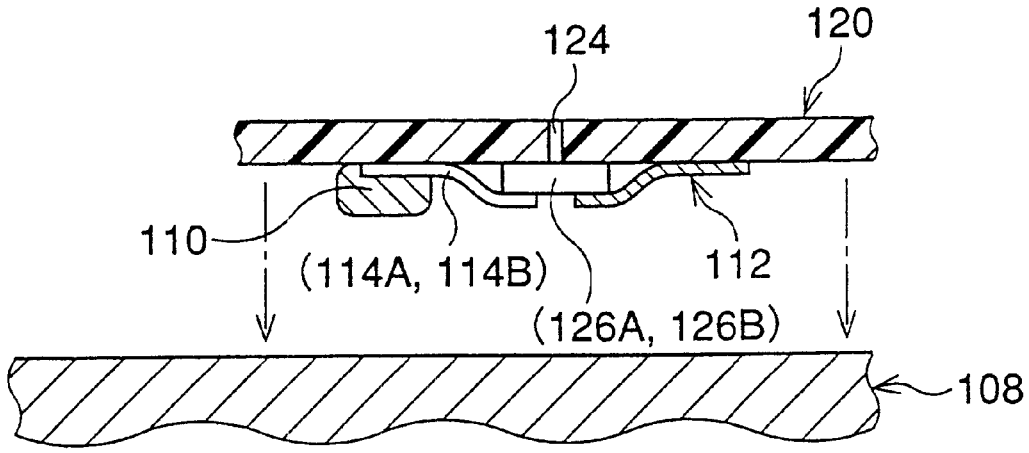
FIG. 32 is a partial cross-sectional view, corresponding to FIG. 24, showing yet another modification of the fourth embodiment of the ink transfer printer.

FIG. 32 shows yet another modification of the fourth embodiment of the ink transfer printer according to the fourth aspect of the present invention. This modified embodiment is substantially identical to the modification of FIG. 31, except that an integrated driver circuit device 110 for selectively and electrically energizing plural sets of electric heater elements 126A and 126B is further previously attached to a sheet of film 120. Note, the same modification can also be included in the first-mentioned modification of FIG. 30.

Figure 33:
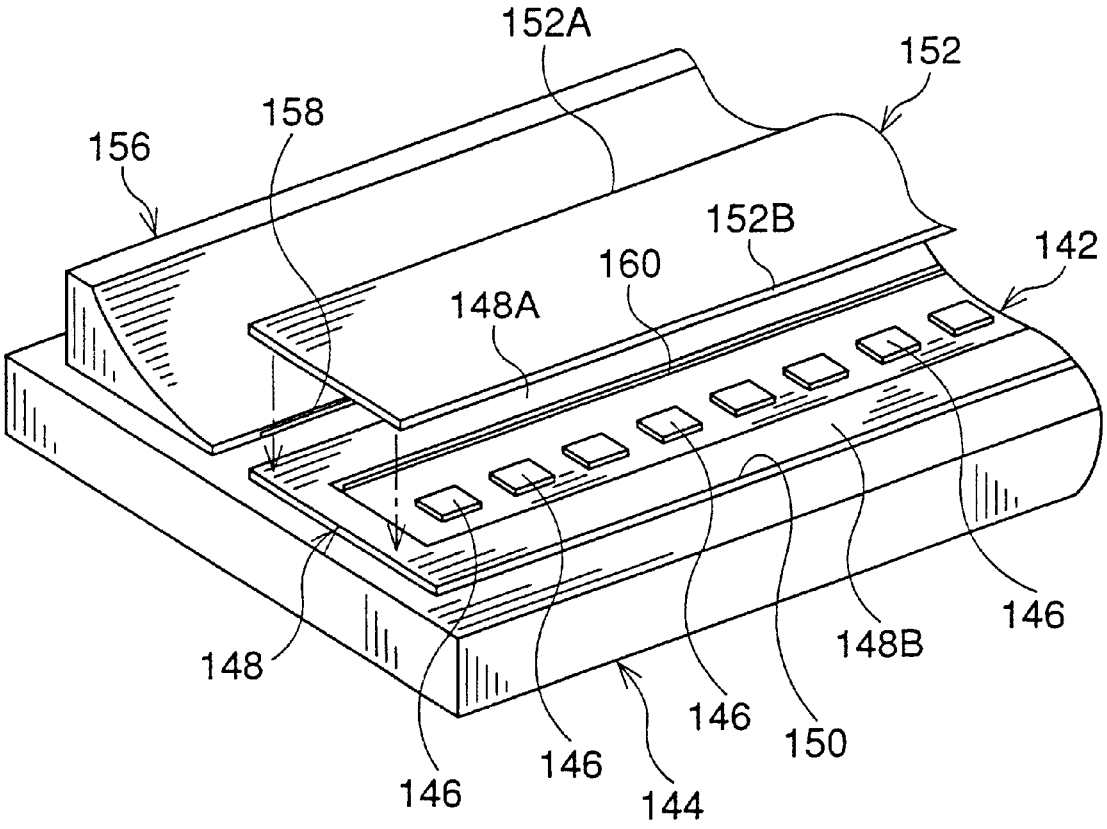
FIG. 33 is a schematic perspective exploded view of a fifth embodiment of an ink transfer printer according to a fifth aspect of the present invention.
Figure 34:
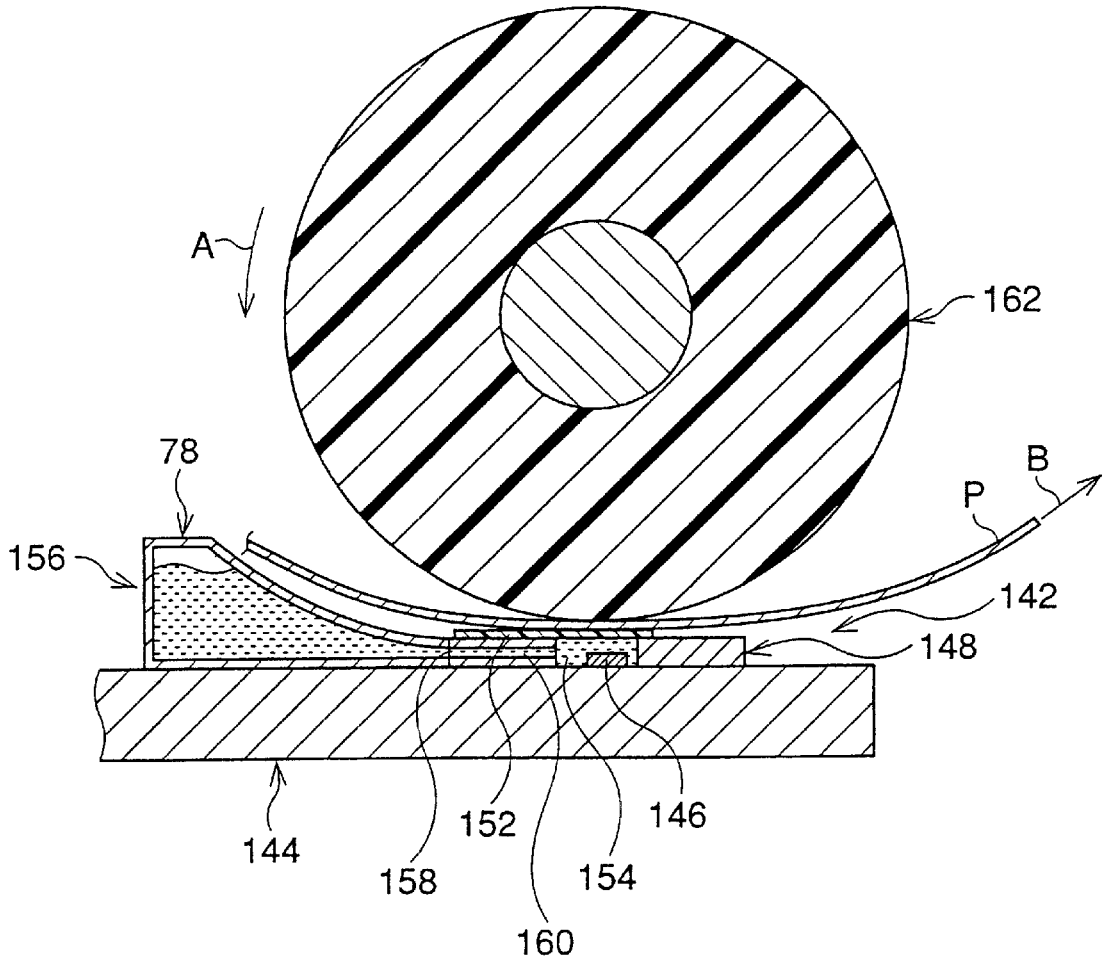
FIG. 34 is a schematic cross-sectional view of the fifth embodiment of the ink transfer printer shown in FIG. 33.

FIGS. 33 and 34 show an ink transfer printer, according to a fifth aspect of the present invention, which will be referred to as a fifth embodiment of the ink transfer printer.

In this fifth embodiment, the ink transfer printer is provided with a thermal line head 142, which comprises an elongated rectangular base plate 144 formed of, for example, a suitable ceramic material, and a plurality of electric resistance elements or electric heater elements 146 aligned on a surface of the base plate 144 in a length direction thereof. Although not illustrated, the thermal line head 142 also comprises an integrated driver circuit pattern, a grounded common terminal pattern, and a wiring circuit pattern, formed on the surface of the base plate 144, for selectively and electrically energizing the electric heater elements 146 in accordance with a series of digital image-pixel signals, as in the case of the first aspect of the present invention.

The ink transfer printer is also provided with an elongated rectangular frame member 148 securely provided on the above-mentioned patterns (not shown) of the base plate 144, and the frame member 148 is formed with an elongated rectangular opening 150 extending in a length direction thereof. Namely, as shown in FIG. 33, the plurality of electric heater elements 146 is encompassed by the rectangular opening 150. Similar to the aforementioned cases, the frame member 148 may be formed of a suitable electrical insulation material, exhibiting a non-permeability to a liquid ink.

The ink transfer printer is further provided with a sheet of film 152 securely provided on the rectangular frame member 148 such that the rectangular opening 150 is covered with the film sheet 152, thereby defining an ink space 154 (FIG. 34). In particular, one of the longitudinal sides of the sheet film 152, indicated by reference 152A in FIG. 33, is securely adhered and sealed to a corresponding one of the longitudinal sides of the frame member 148, indicated by reference 148A; the other longitudinal side of the sheet film 152, indicated by reference 152B in FIG. 33, is not adhered and sealed to the corresponding other longitudinal side of the frame member 148, indicated by reference 148B, but merely contacts the longitudinal side 148B. The lateral sides of the sheet film 152 are securely adhered and sealed to the corresponding lateral sides of the frame member 152. Note, unlike the aforementioned cases, the sheet film 152 is formed without pores.

There may be a gap of about 0.1 mm between the film sheet 152 and the surface of the thermal head 142, and the film sheet 152 may have a thickness of about 0.03 to about 0.08 mm. Preferably, the film sheet 152 is formed of a suitable synthetic resin material, exhibiting a moderate elasticity, a wear-resistant property and a thermal-resistant property. For example, polytetrafluoroethylene can be advantageously used for the film sheet 152.

The ink transfer printer further comprises an ink reservoir 156, with an elongated spout 158 formed therein, securely mounted on the base plate 144. The elongated spout 158 is securely joined to a wide capillary passage 160, formed in the longitudinal side 148A of the frame member 148, such that the ink reservoir 156 is in communication with the ink space 154 via the wide capillary passage 160. Thus, liquid ink, held in the ink reservoir 156, can be drawn into the ink space 154, due to capillary action of the wide capillary passage 160. Namely, the ink space 154 is fed and filled with the liquid ink from the ink reservoir 156.

As shown in FIG. 34, the ink transfer printer is further provided with a platen roller 162 constituted as a rubber roller, and the platen roller 162 is rotatably provided above and in contact with the film sheet 152 along the longitudinal perimeter side 152B thereof, such that a rotational axis of the platen roller 162 is in parallel with the alignment of the electric heater elements 146. The platen roller 162 is rotated, in a direction indicated by an arrow A in FIG. 34, with a suitable electrical motor (not shown). During the rotation of the platen roller 162, a sheet of recording paper P, introduced into a nip between the film sheet 152 and the platen roller 162, is subjected to a traction force from the rotating platen roller 162, and thus the recording paper sheet P is moved in a direction indicated by an arrow B in FIG. 34.

Figure 35:
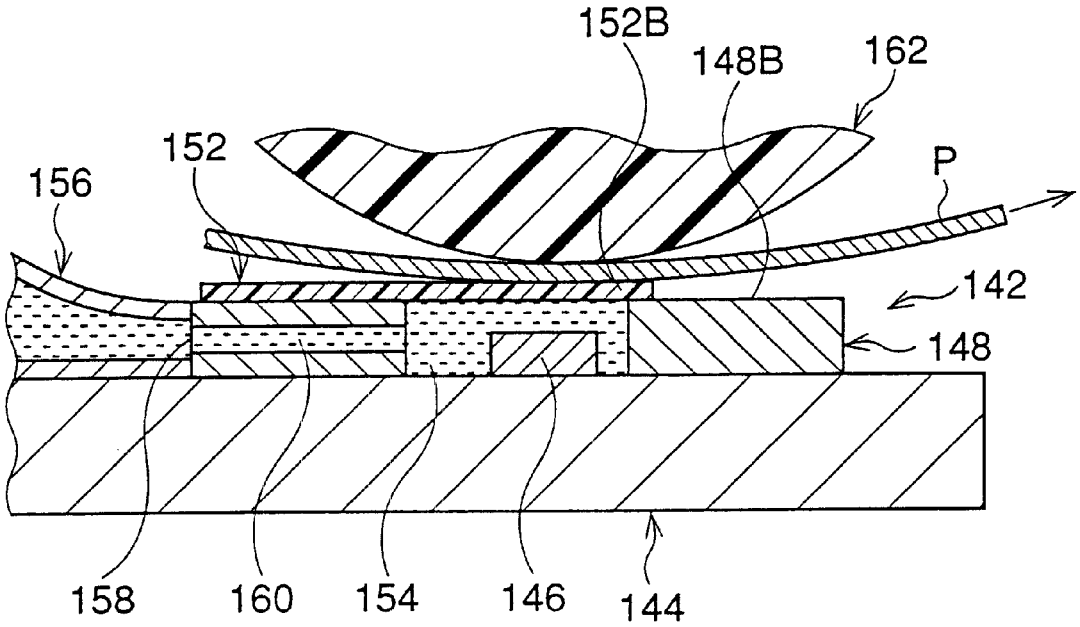
FIG. 35 is a schematic partially-enlarged cross-sectional view of the ink transfer printer, shown in FIG. 34, for explaining a principle of a printing operation, according to the fifth aspect of the present invention.
Figure 36:
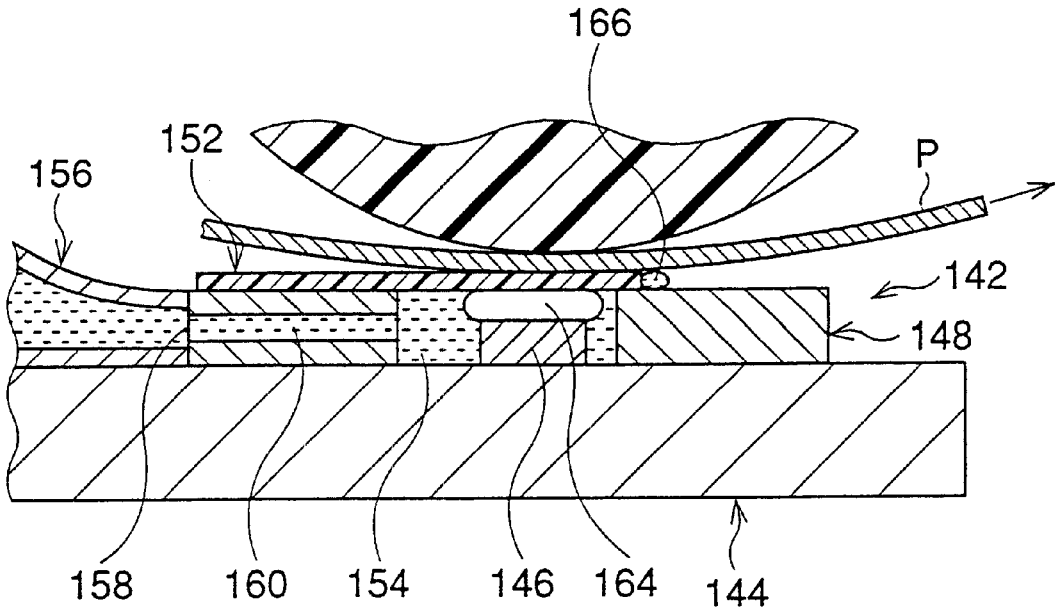
FIG. 36 is a schematic partially-enlarged cross-sectional view, similar to FIG. 35, showing the ink transfer printer concerned during the printing operation.
Figure 37:
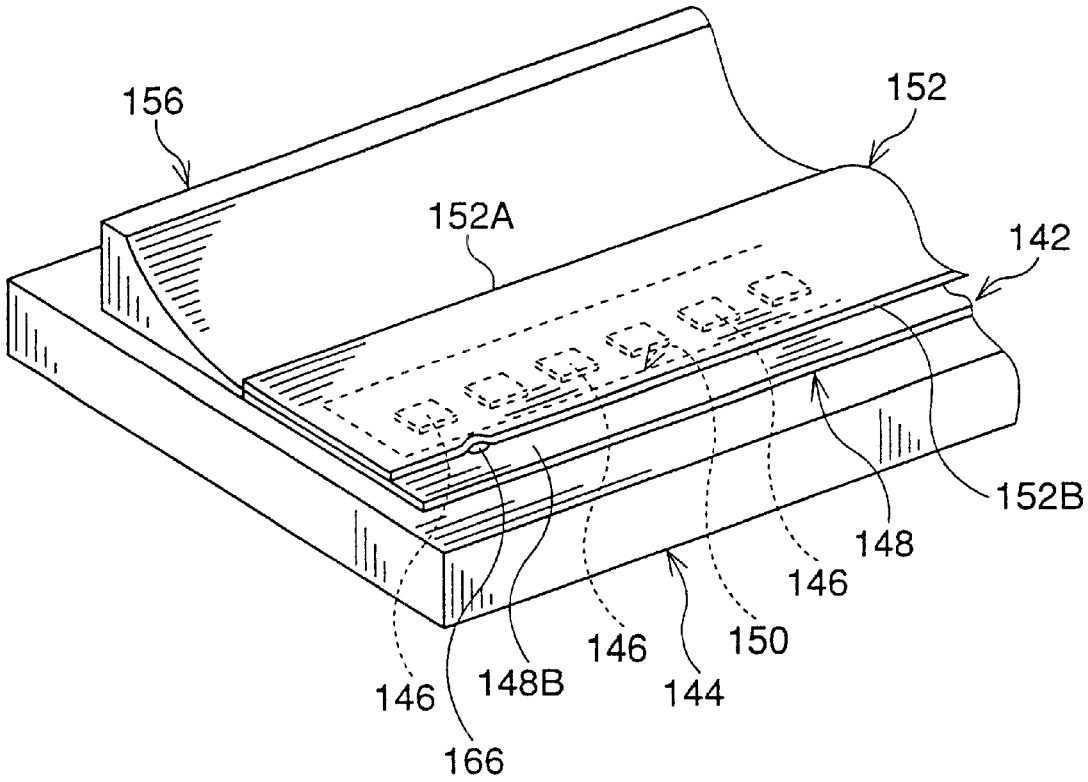
FIG. 37 is a schematic perspective view showing the ink transfer printer shown in FIG. 36.

With reference to FIGS. 35, 36 and 37, a principle of a printing operation, as performed by the ink transfer printer according to the fifth aspect of the present invention is conceptually illustrated.

As shown in FIG. 35, usually, an elongated central area of the film sheet 152 is located in extremely close proximity to the electric heater elements 146, and the longitudinal side 152B of the sheet film 152 is pressed against a surface of the longitudinal side 148B of the frame member 148, due to the existence of the platen roller 162, whereby leakage of ink from the ink space 154 through a closed slit formed between the longitudinal sides 148B and 152B is prevented.

When one of the electric heater elements 146 is heated by an electrical energization thereof, the electric heater element 146 concerned is heated to a predetermined temperature. Thus, a part of the ink, in contact with the heated heater element 146, is vaporized, thereby producing a bubble 164, as shown in FIG. 36. Also, a local area of the film sheet 152, corresponding to the heated heater element 146, is heated so that a modulus of elasticity of the heated local area decreases. As a result, the heated local area of the film sheet 42 inflates due to the decrease in the modulus of elasticity thereof and a vapor pressure generated in the bubble 164. Further, a part of the ink, pressurized by the vapor pressure, can permeate and penetrate into the closed slit formed between the longitudinal sides 148B and 152B.

Accordingly, as shown in FIGS. 36 and 37, the permeated and penetrated ink appears out of the closed slit, formed by the longitudinal sides 148B and 152B, as a fine ink drop 166, due to a pressurization caused by the platen roller 162. The fine ink drop 166 is transferred to the recording paper sheet P, and the transferred fine ink drop 166 produces a single dot on the paper sheet P. Of course, the transfer of the fine ink drop 166 to the paper sheet P should be completely performed, because, if a part of each ink drop is left on the film sheet 152, the paper sheet P is stained with the remaining ink. The film sheet 152, formed of polytetrafluoroethylene, exhibits a high transferability of a liquid ink to a sheet of recording paper.

According to the fifth aspect of the present invention, it is possible to manufacture the ink transfer printer at low cost, because a troublesome and expensive piercing of pores in a blank film sheet is unnecessary.

Figure 38:
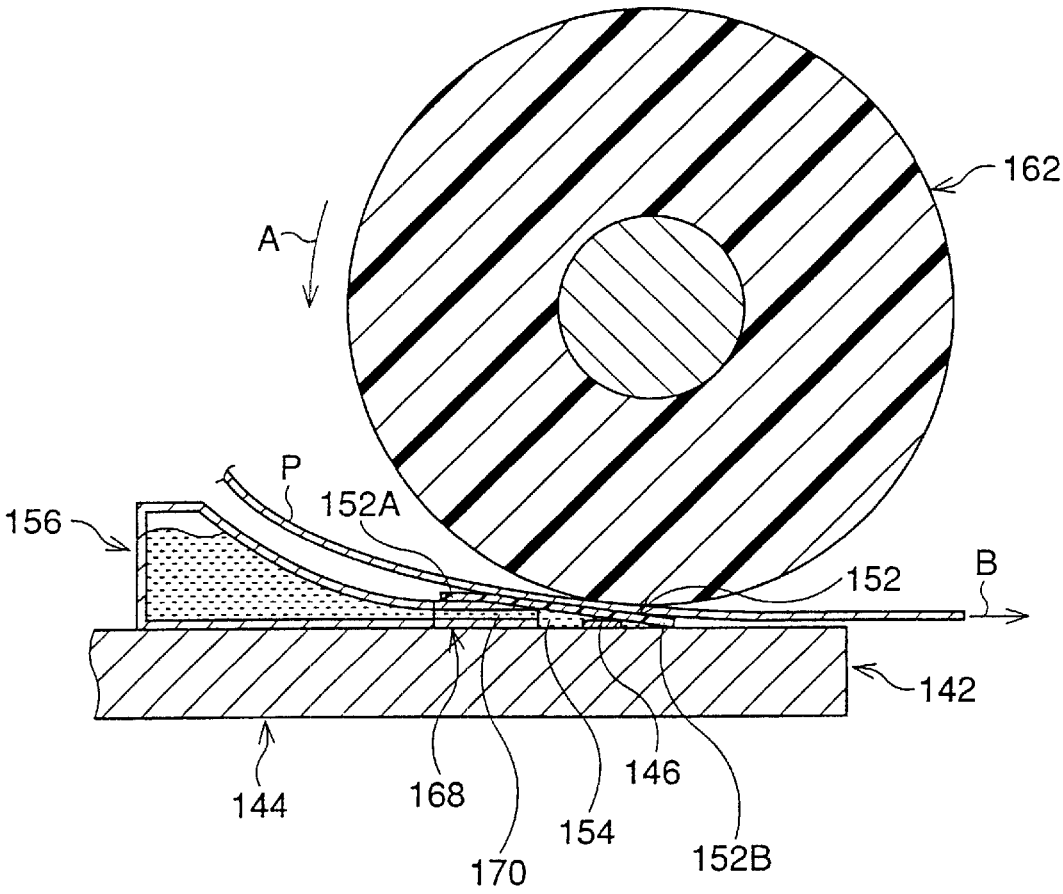
FIG. 38 is a schematic cross-sectional view, corresponding to FIG. 34, showing a modification of the fifth embodiment of the ink transfer printer according to the fifth aspect of the present invention.

FIG. 38 shows a modification of the fifth embodiment of the ink transfer printer according to the fifth aspect of the present invention. Note, in this drawing, the features similar to those of FIGS. 33 and 34 are indicated by the same reference numerals. This modified embodiment is substantially identical to the ink transfer printer shown in FIGS. 33 and 34 except that an elongated spacer member 168 is substituted for the elongated rectangular frame member 148.

The elongated spacer member 168 has a wide capillary passage 170 formed therein, which extends in a length direction thereof, and is securely joined to an elongated spout of an ink reservoir 156, such that the wide capillary passage 170 is in communication with the ink reservoir 156. Also, a sheet of film 152 is securely provided on an elongated base plate 144, such that a plurality of electric heater elements 146 is covered with the film sheet 152 so as to define an ink space 154 therebetween. In particular, a longitudinal side 152A of the sheet film 152 is securely adhered and sealed to the spacer member 168; the other longitudinal side 152B of the sheet film 152 is not adhered and sealed to a surface of the base plate 144, but merely contacts the surface of the base plate 144. The lateral sides of the sheet film 152 are securely adhered and sealed to the surface of the base plate 144. Note, of course, the sheet film 152 is formed without pores.

Liquid ink, held in the ink reservoir 156, can be drawn into the ink space 154, due to capillary action of the wide capillary passage 170 of the spacer member 168. Namely, the ink space 154 is fed and filled with the liquid ink from the ink reservoir 156.

A principle of a printing operation, performed by the modified ink transfer printer is substantially identical to the printing-principle of the ink transfer printer shown in FIGS. 33 and 34. In particular, the longitudinal side 152B of the sheet film 152 is usually pressed against the surface of the base plate 144, due to the existence of a platen roller 162, whereby leakage of ink from the ink space 154 through a closed slit formed between the longitudinal side 152B and the base plate surface is prevented.

When one of the electric heater elements 146 is heated by an electrical energization thereof, the heater element 146 concerned is heated to a predetermined temperature. Thus, a part of the ink, in contact with the heated heater element 146, is vaporized, thereby producing a bubble (164). Also, a local area of the film sheet 152, corresponding to the heated heater element 146, is heated so that a modulus of elasticity of the heated local area decreases. As a result, the heated local area of the film sheet 152 inflates due to the decrease in the modulus of elasticity thereof and a vapor pressure generated in the bubble (164). Further, a part of the ink, pressurized by the vapor pressure, can permeate and penetrate into the closed slit formed between the longitudinal side 152B and the surface of the base plate 144.

Similar to the ink transfer printer of FIGS. 33 and 34, the permeated and penetrated ink appears as a fine ink drop out of the closed slit formed between the longitudinal side 152B and the surface of the base plate 144, due to a pressurization caused by the platen roller 162. The fine ink drop is transferred to the recording paper sheet P, and the transferred fine ink drop produces a single dot on the paper sheet P.

Finally, it will be understood by those skilled in the art that the foregoing description is of preferred embodiments of the thermal line head and the ink transfer printer, and that various changes and modifications may be made to the present invention without departing from the spirit and scope thereof.

What is claimed is:

1. An ink transfer printer comprising:

an electrically-insulated base member;

a plurality of electric resistance elements linearly formed on a surface of said base member;

a frame member, having an opening, securely provided on the surface of said base member such that said plurality of electric resistance elements are encompassed by said opening of said frame member;

a sheet of film, having a linear perimeter side, adhered and sealed to said frame member, except for said linear perimeter side, such that said opening of said frame member is defined as an ink space that stores ink, said linear perimeter side of said film sheet extending along the linear formation of said plurality of electric resistance elements, and contacting a surface of said frame member; and a platen roller rotatably provided above and in contact with said film sheet such that a rotational axis of said platen roller is in parallel with the linear formation of said plurality of electric resistance elements, the linear perimeter side of said film sheet being pressed against the surface of said frame member so as to form a closed slit therebetween, wherein, when each of said electric resistance elements is electrically energized to generate thermal energy, a part of the ink penetrates said closed slit, due to the generation of the thermal energy, and then exits said closed slit as a fine ink drop.

2. The ink transfer printer as set forth in claim 1, further comprising an ink reservoir provided on the surface of said base member, said ink reservoir communicating with said ink space via a passage formed in said frame member, whereby said ink space is fed with ink from said ink reservoir.

3. The ink transfer printer as set forth in claim 1, wherein said film sheet is a synthetic resin material having a property that is at least one of elastic, wear-resistant and thermal-resistant.

4. The ink transfer printer as set forth in claim 3, wherein said synthetic resin material is polytetrafluoroethylene.

5. An ink transfer printer comprising:

an electrically-insulated base member;

a plurality of electric resistance elements linearly formed on a surface of said base member;

a spacer member securely provided on the surface of said base member along the linear formation of said plurality of electric resistance elements;

a sheet of film, having a linear perimeter side, adhered and sealed to said spacer member and the surface of said base member, except for said linear perimeter side, such that an ink space, that stores ink, is defined so as to include the linear formation of said plurality of electric resistance elements, the linear perimeter side of said film sheet extending along the linear formation of said plurality of electric resistance elements, and contacting the surface of said base member; and a platen roller that is rotatably provided above and in contact with said film sheet such that a rotational axis of said platen roller is in parallel with the linear formation of said plurality of electric resistance elements, the linear perimeter side of said film sheet being pressed against the surface of said base member so as to form a closed slit therebetween, wherein, when each of said plurality electric resistance elements is electrically energized to thereby generate thermal energy, a part of the ink penetrates said closed slit, due to the generation of the thermal energy, and then exits said closed slit as a fine ink drop.

6. The ink transfer printer as set forth in claim 5, further comprising an ink reservoir provided on the surface of said base member, said ink reservoir communicating with said ink space via a passage formed in said spacer member, whereby said ink space is fed with ink from said ink reservoir.

7. The ink transfer printer as set forth in claim 5, wherein said film sheet is formed of a suitable synthetic resin material, such as polytetrafluoroethylene, exhibiting at least a moderate elasticity, a wear-resistant property and a thermal-resistant property.

8. The ink transfer printer as set forth in claim 5, wherein said film sheet is a synthetic resin material having a property that is at least one of elastic, wear-resistant and thermal-resistant.

9. The ink transfer printer as set forth in claim 8, wherein said synthetic resin material is polytetrafluoroethylene.

* * * * *